US010895013B2

(12) United States Patent
Jelinek et al.

(10) Patent No.: US 10,895,013 B2
(45) Date of Patent: Jan. 19, 2021

(54) GOLD NANOSTRUCTURES AND PROCESSES FOR THEIR PREPARATION

(71) Applicant: BEN GURION UNIVERSITY OF THE NEGEV RESEARCH AND DEVELOPMENT AUTHORITY, Beer-Sheva (IL)

(72) Inventors: Raz Jelinek, Reut (IL); Ahiud Morag, Nes Ziona (IL)

(73) Assignee: BEN GURION UNIVERSITY OF THE NEGEV RESEARCH AND DEVELOPMENT AUTHORITY, Beer Sheva (IL)

( * ) Notice: Subject to any disclaimer, the term of this patent is extended or adjusted under 35 U.S.C. 154(b) by 103 days.

(21) Appl. No.: 14/438,380

(22) PCT Filed: Nov. 10, 2013

(86) PCT No.: PCT/IL2013/000082

§ 371 (c)(1),
(2) Date: Apr. 24, 2015

(87) PCT Pub. No.: WO2014/072969

PCT Pub. Date: May 15, 2014

(65) Prior Publication Data

US 2015/0345025 A1 Dec. 3, 2015

Related U.S. Application Data

(60) Provisional application No. 61/724,308, filed on Nov. 9, 2012, provisional application No. 61/833,465, filed on Jun. 11, 2013.

(51) Int. Cl.
*C23C 18/31* (2006.01)
*C23C 18/16* (2006.01)
(Continued)

(52) U.S. Cl.
CPC ..... *C23C 18/31* (2013.01); *C23C 18/08* (2013.01); *C23C 18/1608* (2013.01);
(Continued)

(58) Field of Classification Search
CPC . C23C 18/31; C23C 18/1637; C23C 18/1803; C23C 18/1608; C23C 18/54; C23C 18/1844; C23C 18/1893
See application file for complete search history.

(56) References Cited

U.S. PATENT DOCUMENTS 4,009,297 A * 2/1977 Redmond ..... C23C 18/44 427/252
4,719,145 A * 1/1988 Neely ..... C23C 18/28 427/203
(Continued)

FOREIGN PATENT DOCUMENTS

JP 62174384 1/1989
JP 0971871 9/1995

OTHER PUBLICATIONS

Flavel B.S. et al: "Solution chemistry approach . . . electronics", 2008, Nanotechnology, vol. 19, No. 445301, pp. 1-12.
(Continued)

*Primary Examiner* — Dah-Wei D. Yuan
*Assistant Examiner* — Nga Leung V Law
(74) *Attorney, Agent, or Firm* — Nixon & Vanderhye P.C.

(57) ABSTRACT

An electroless process for depositing gold ($Au^0$) from a solution, comprising allowing gold ($Au^0$) place from a solution of gold thiocyanate complex dissolved in a mixture of water-miscible organic solvent and water, or the deposition of gold ($Au^0$) takes place on a deposition-directing layer comprising positively charged organic groups, said layer being provided on at least a portion of a surface of a substrate sought to be gold-coated.

16 Claims, 14 Drawing Sheets

(51) Int. Cl.

| | |
|---|---|
| ***C23C 18/42*** | (2006.01) |
| ***C23C 18/18*** | (2006.01) |
| ***C23C 18/54*** | (2006.01) |
| ***C23C 18/08*** | (2006.01) |
| ***C23C 18/20*** | (2006.01) |

(52) U.S. Cl.

CPC ..... *C23C 18/1637* (2013.01); *C23C 18/1803* (2013.01); *C23C 18/1844* (2013.01); *C23C 18/1893* (2013.01); *C23C 18/2006* (2013.01); *C23C 18/2086* (2013.01); *C23C 18/42* (2013.01); *C23C 18/54* (2013.01); *Y10T 428/249924* (2015.04); *Y10T 442/109* (2015.04)

(56) References Cited

U.S. PATENT DOCUMENTS 7,011,697 B2 5/2006 Kato et al.
7,364,920 B2 * 4/2008 Braun ..... G01N 33/553 436/525

OTHER PUBLICATIONS

Vinod, T.E.: "Transparent, conductive, and . . . template", 2013, Nanoscale, vol. 5, pp. 10487-10493.
Jin, Y. et al: "Controlled nucleation and . . . substrates", 2001, Anal. Chem., vol. 73, No. 13, pp. 2843-2849.
Guan, F. et al: "Fabrication of patterned . . . plating", 2004, vol. 240, No. 1-4, pp. 24-27.
Liu, S. et al: "Planned nanostructures of . . . functionality", 2004, Nano Letters, vol. 4, No. 5, pp. 845-851.
Lyons, P.E. et al: "High-performance transparent . . . nanowires", 2011, J. Phys. Chem. Lett, vol. 2, No. 24, pp. 3058-306.
Morag, A. et al: "Patterned transparent conductive . . . thiocyanate", 2013, Adv. Funct. Mater, vol. 23, No. 45, pp. 5663-5668.
Morag, A. et al: "Transparent, conductive gold . . . thiocyanate", 2013, Chem. Commun., vol. 49, pp. 8552-8554.
Israeli Patent Office, Written Opinion of the International Searching Authority, International Application No. PCT IIL20 13/000082, dated Mar. 13, 2014.
Israeli Patent Office, Search Report of the International Application No. PCT IIL20 13/000082, dated Mar. 6, 2014.

* cited by examiner

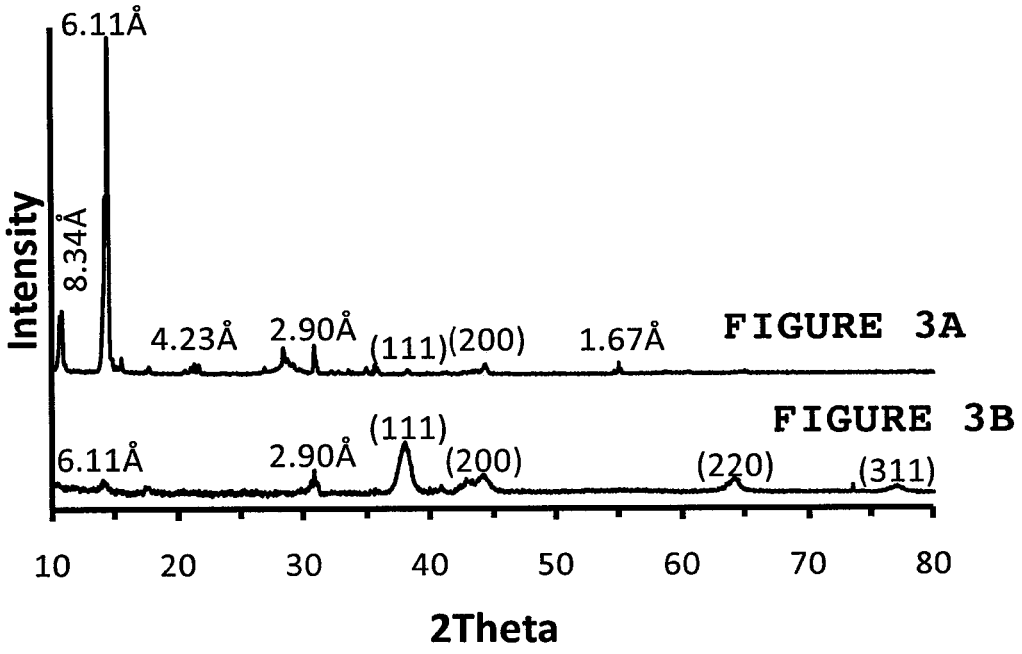
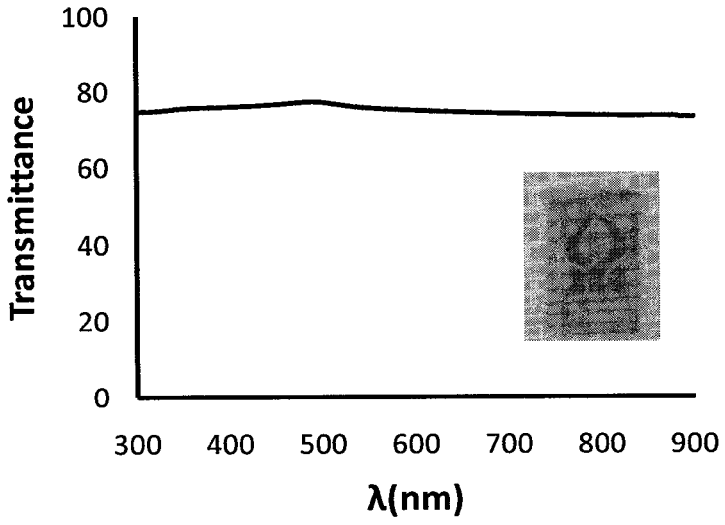
FIGURE 4

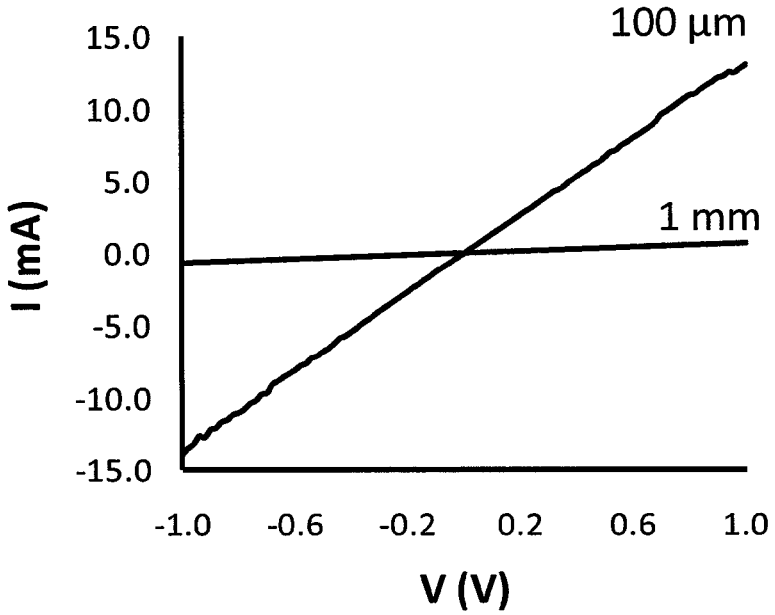
FIGURE 5
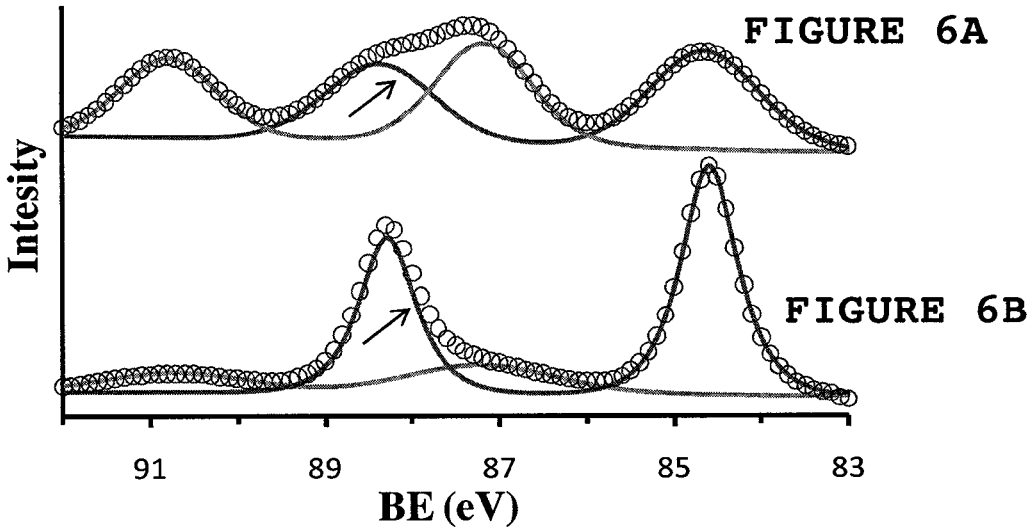

GOLD NANOSTRUCTURES AND PROCESSES FOR THEIR PREPARATION

CROSS-REFERENCE TO RELATED APPLICATIONS

The present application is a National Stage of PCT International Application Serial Number PCT/IL2013/000082, filed Nov. 10, 2013, which claims priority under 35 U.S.C. § 119 of U.S. Provisional Patent Applications Ser. No. 61/724,308, filed Nov. 9, 2012, and No. 61/833,465, filed Jun. 11, 2013, the disclosures of which are incorporated by reference herein.

FIELD OF THE INVENTION

The invention relates to the preparation of metallic gold ($Au^0$) nanostructures, such as gold nanowires and gold coatings, which exhibit high crystallinity, transparency and electrical conductivity and are hence useful, for example, in the construction of thin-film electrodes and for other applications involving gold plating.

BACKGROUND OF THE INVENTION

There exist a need, especially in the electronics industry, to produce gold patterns and thin films on various surfaces. To this end, the electroless deposition of gold from a solution onto a substrate can be employed. A substrate sought to be coated is immersed in a solution which contains a gold complex as a gold source and a reducing agent. For example, JP 62-174384 describes an electroless gold plating solution comprising an alkali salt of $[Au(S_2O_3)_2]^{3-}$, a complexing agent, which is thiocyanate ($SCN^-$), and a reducer, which is thiourea. JP 9-071871 describes an electroless gold plating solution where the water soluble gold salt can be gold thiocyanate and the reducing agent is ascorbic acid. U.S. Pat. No. 7,011,697 discloses a cyanide-based solution comprising the species $[Au(CN)_2]^{1-}$ and ascorbic acid as the reducer. A complexing agent, which is a thiocyanate compound, is also present in the solution. U.S. Pat. No. 7,364,920 relates to a method for gold deposition, using $KAu(SCN)_2$ solution which contains hydroquinone as a reducing agent. The substrate sought to be coated by the $KAu(SCN)_2$ solution is initially modified, prior to the gold deposition step, to provide gold-containing nucleation centers onto its surface, for receiving the gold to be deposited from the solution.

SUMMARY OF THE INVENTION

We found that solutions of gold thiocyanate complexes, namely, solutions comprising either $[Au(SCN)_4]^{1-}$, $[Au(SCN)_2]^{1-}$ or both, can be used for depositing and crystallizing metallic gold ($Au^0$) nanostructures. The assembly of gold ($Au^0$) nanostructures occurs when the solution is devoid of an auxiliary reducing agent. The term "nanostructure" is understood to be a structure that is characterized by at least one dimensional feature (e.g., thickness, height, length and the like) being in the nanometer scale, e.g., between 1 and 1000 nanometers or between 5 and 500 nanometers.

The oxidation states of gold in the two thiocyanate complexes identified above are 3+ and 1+, respectively. In certain conditions, e.g. in aqueous solution, $[Au(SCN)_4]^{1-}$ may spontaneously convert into $[Au(SCN)_2]^{1-}$. Hereinafter, the term "gold thiocyanate complex" is used to indicate either the auric complex, the aurous complex or a mixture thereof.

The experimental results reported below indicate that metallic gold ($Au^0$) is self-assembled to form nano-wires when allowed to slowly crystallize from a solution of gold thiocyanate dissolved in a mixture of an organic solvent and water, even in the absence of auxiliary reducer.

Experimental work conducted in support of this invention also demonstrates that aqueous solutions of gold thiocyanate complexes are useful for deposition of metallic gold ($Au^0$) patterns and films on substrates provided with positively charged organic groups on their surfaces. Specifically, the incubation of $[Au(SCN)_2]^{1-}$ aqueous solution with a substrate having amine-displaying region on its surface gave rise to the deposition of gold nanostructures in a ribbon-like pattern, which occurred specifically at the amine-displaying region. No deposition of gold was observed outside the boundaries of the amine-displaying region. The process is believed to be directed by electrostatic attraction between the negatively charged gold complex in solution and the positively charged amine groups provided on the substrate in the region sought to be coated.

The invention relates to an electroless process for depositing gold ($Au^0$) from a solution, comprising allowing gold ($Au^0$) to deposit from a solution of gold thiocyanate complex, wherein the deposition of gold ($Au^0$) takes place from a solution of gold thiocyanate complex dissolved in a mixture of water-miscible organic solvent and water, or the deposition of gold ($Au^0$) takes place on a deposition-directing layer comprising positively charged non-metallic groups, said layer being provided on at least a portion of a surface of a substrate sought to be gold-coated.

A first variant of the invention is a process comprising dissolving $[Au(SCN)_4]^{1-}$ source in a mixture of water-miscible organic solvent and water, and crystallizing gold ($Au^0$) wires from the so-formed solution, preferably in the absence of an auxiliary reducing agent. Preferably, the crystallization is induced by gradually removing the solvent mixture, e.g., allowing the solvent mixture to evaporate slowly. For example, by "slow evaporation" is meant that a volume of 1 ml is allowed to undergo evaporation for a period of not less than 1 hour, e.g., not less than 3 hours. The so-formed gold ($Au^0$) wires contain also $Au^{3+}$ compound. The process further comprises the step of subjecting the wires to a reductive environment, increasing the content of gold ($Au^0$) in the wires.

The electroless deposition solution set forth above, comprising gold thiocyanate complex {e.g., $[Au(SCN)_4]^{3-}$} dissolved in a mixture of water-miscible organic solvent and water, wherein the organic solvent is preferably aprotic solvent, especially DMSO, forms another aspect of the invention.

Another aspect relates to a plurality of gold ($Au^o$) wires supported on a substrate and arranged in a network structure, having diameter ranging from 100 to 500 nm, with the length of the wires being not less than 100 μm, preferably not less than 200 μm, e.g., from 200 to 300 μm and, wherein said wires further comprise crystalline $Au^{3+}$-containing compound [e.g., exhibiting X-ray powder diffraction pattern having one or more characteristic peaks indicative of $Au^{3+}$, for example, at 2θ position corresponding to d-spacing of 6.1 Å (±0.05) in the case of $[Au(SCN)_4]^-$]. The gold wires may be further characterized by rough surface.

A second variant of the invention is a process comprising providing a substrate having, on at least a portion of a surface of the substrate, a deposition-directing layer which contains positively charged non-metallic groups, e.g., positively charged organic groups such as amine groups, and contacting said deposition-directing layer with a solution of gold thiocyanate complex, to deposit gold ($Au^0$) film on said deposition-directing layer. The solution is preferably an aqueous solution devoid of an auxiliary reducing agent. The substrate sought to be gold-coated is either planar or curved. The process further comprises the step of subjecting the film to a reductive environment, increasing the content of gold ($Au^0$) in the film, and/or treating the film with conductivity enhancing agent, e.g., a conductive polymer.

The invention also provides a substrate-supported gold film. The gold film comprises a plurality of gold ($Au^0$)-containing nanostructures protruding from the substrate surface and forming a mesh, wherein said gold film has thickness in the range between 30 and 400 nanometers, wherein the gold nanostructures are interlaced or interconnected with other nearby nanostructures. The gold nanostructures are non-straight, and may have ribbon-like shape.

DETAILED DESCRIPTION OF THE INVENTION

One aspect of the invention relates to the preparation of gold ($Au^0$) wires which are self-assembled upon slow crystallization from a solution of gold thiocyanate complex.

Gold wires of the invention are prepared by combining, in an aqueous solution, an auric ($Au^{3+}$) compound together with a source the thiocyanate anion ($SCN^-$), to form a sparingly soluble or water insoluble auric complex, separating the auric complex from the aqueous phase, dissolving said auric complex in a solvent mixture comprising one or more water miscible organic solvents and water, crystallizing gold ($Au^{0*}$)-containing solid e.g., gold wires, from said organic-aqueous medium which is preferably free of auxiliary reducing agent, collecting said wires and optionally reducing $Au^{p+}$ (p=1 or 3, especially 3) present in said wires to $Au^0$, affording essentially metallic wires.

The auric compound, for example hydrogen aurichloride (or a salt of said acid with a base, e.g., sodium aurichloride), is added to an aqueous solution of thiocyanate salt, especially the potassium salt which is the most stable of the alkali thiocyanates. The reactants can be applied in stoichiometric quantities, but preferably the thiocyanate salt is used in excess, e.g., of not less than 5:1, up to a molar ratio of 10:1. The reaction, which generally takes place at room temperature, results in the instantaneous precipitation of a salt of the formula $MAu(SCN)_4$, wherein M indicates an alkali metal, preferably potassium. It should be noted that $KAu(SCN)_4$ is sparingly soluble in water at room temperature, and is separable from the mother liquor by conventional methods such as centrifugation.

Thus, a preferred source of $[Au(SCN)_4]^{1-}$ to be employed in the deposition process is $MAu(SCN)_4$. The solid (optionally dried) complex salt is dissolved in an organic-aqueous medium comprising one or more water miscible organic solvents and water. The volume ratio between the organic and aqueous components in the solvent mixture is not less than 2:1, preferably between 3:1 and 5:1. Preferably, polar-aprotic organic solvents are used, e.g., dimethyl sulfoxide (DMSO), N,N-dimethylformamide (DMF) and ethers such as tetrahydrofurane (THF). However, the organic component of the solution can also be selected from the group of protic solvents, for example alcohol or glycol such as ethylene glycol. The dissolution of the $MAu(SCN)_4$ generally requires no heating, and may be achieved at room temperature. The concentration of the complex salt in the solution may be from 0.5 mg $mL^{-1}$ to 100 mg $mL^{-1}$.

The crystallization of the nanowires takes place when the aforementioned solution is allowed to stand at room temperature for not less than 24 hours, whereupon a gradual, slow evaporation of the solvent occurs. For some applications it is advantageous to deposit the nanowires on a suitable support, e.g., to produce substrate-supported gold wires. To this end, the solution is allowed to stand at room temperature for about 24 h to 48 h hours and is then applied onto a surface of a suitable support, following which the solvent evaporates completely (e.g., a solution casting method is employed) to form the substrate-supported film consisting of dispersed nanowires, or nanotubes, i.e., cylindrical bodies with length/diameter ratio of preferably not less than 250:1.

Scanning electron microscopy (SEM) analysis of the nanowires-containing film obtained following solvent evaporation shows a network structure consisting of individual nanowires exhibiting uniform, smooth appearance with diameter of about 300 nm and length of up to several hundred micron. X-ray photoelectron spectroscopy (XPS) confirms the formation of metallic gold, revealing that the nanowires contain $Au^0$ and $Au^{3+}$ at a ratio of about 40:60 to 50:50. X-ray powder diffraction analysis indicates that the nanowires are crystalline, with diffraction lines assigned to $Au^{3+}$-containing species at positions corresponding to d-spacings of 8.34 Å, 6.11 Å and 2.90 Å.

The next step of the process is optional and serves the purpose of upgrading the conductivity of the gold nanowires. The step involves the reduction of the $Au^{3+}$ ion present in the nanowires to $Au^0$, transforming the nanowires into an essentially metallic forma Preferably, plasma reduction is employed for this purpose. The substrate-supported film is placed in a plasma chamber, e.g., in a commercially available plasma instrument used for cleaning. The plasma chamber is connected to a vacuum pump, and plasma is generated at pressure of 0.1-1 Torr by using radio frequency (RF) power supply operating at 18 W for not less than 3 minutes, effectively reducing $Au^{p+}$ to $Au^0$.

Scanning electron microscopy (SEM) analysis of the nanowires-containing film obtained following plasma reduction indicates a morphological change: the plasma reduction is associated with roughening the surface of the nanowires. X-ray powder diffraction analysis indicates the effectiveness of the reduction process, showing that the intensity of diffraction lines characteristic of $Au^{3+}$ species decreases significantly, such that the XRD exhibits mainly peaks assigned to $Au^0$ (e.g., at 38 and 44 2θ positions). X-ray photoelectron spectroscopy (XPS) reveals that following the reduction, the nanowires contain gold in two oxidation states, of 0 and 3+, at a ratio of at least 70:30, e.g., at least 3:1 (for example, from 3:1 to 5:1).

Another aspect of the invention therefore relates to a plurality of gold ($Au^o$) wires, preferably supported on a substrate and arranged in a network structure, with the length of the wires being not less than 100 μm, preferably not less than 200 μm, e.g., from 200 to 300 μm and diameter ranging from 100 to 500 nm, wherein said wires further comprise crystalline $Au^{3+}$-containing compound [e.g., exhibiting X-ray powder diffraction pattern having one or more characteristic peaks indicative of $Au^{3+}$, for example, at 2θ position corresponding to d-spacing of 6.1 Å (±0.05) in the case of $[Au(SCN)_4]^-$]. The gold wires are further characterized by rough surface.

Another aspect of the invention relates to electroless deposition of gold ($Au^0$) from a solution of gold thiocyanate complex onto a substrate, to form gold patterns, films and coatings on the surface of said substrate, wherein a deposition-directing layer comprising positively-charged organic groups is provided on said surface. For example, the surface is amine-displaying surface. Hereinafter, the term "amine-functionalized substrate" indicates a substrate whose surface has been treated to have amine groups thereon. Methods for obtaining "amine-functionalized substrate" are known in the art {Kamisetty et al. [Anal. Bioanal. Chem. 386, 1649 (2006)]; Howarter et al. [Langmuir, 22, 11142 (2006)]; Roth et al. [Lagmuir, 24, 12603 (2008)]; and Hsiao et al. [J. Mater. Chem. 17, 4896 (2007)]}.

The solution employed for the electroless deposition of gold films, patterns and coatings on a surface of a substrate as set forth above is preferably an aqueous solution devoid of a reducing agent. The complex is $[Au(SCN)_2]^{1-}$. The concentration of the complex in the aqueous solution may be from 0.5 mg $mL^{-1}$ to 100 mg $mL^{-1}$. The pH of the reaction mixture is acidic, preferably between 1 and 6.

The surface sought to be gold-coated is generally planar. However, the method of the invention allows the formation of gold film on non-planar, curved surfaces as well. In the latter case, the deposition of gold from the gold thiocyanate solution can take place directly on the curved surface. The experimental results reported below indicate that the gold film exhibits good conductivity even in a curved geometry. For example, the substrate sought to be coated may have a regularly-spaced, wave surface morphology. The curved surface sought to be coated may be the lateral surface of a cylinder or a cone, or a portion of said lateral surfaces; a spherical surface or a portion thereof, e.g., a spherical segment, a spherical sector and spherical layer, or the surface of torus. It should also be noted that gold deposition from the solution can be affected on a planar substrate, followed by a step of deforming (e.g. bending) the planar surface to form a curved surface.

The substrate may be any substrate that is capable of being modified to have on its surface a deposition-directing layer bearing positively-charged organic groups. The substrate is preferably non-metallic, non-conductive substrate. The substrate may be glass, mica, carbon, silicon (comprising silicon oxide), a polymer, such as polystyrene and an organosilicon polymer (e.g., polydimethylsiloxane (PDMS)). The substrate may also be a metal (comprising metal oxide).

The deposition-directing layer bearing positively-charged organic groups provided on the surface of the substrate sought to be gold-coated may comprise one or more molecules having at least one positively charged moiety. The deposition-directing layer is positively charged in an aqueous environment.

The deposition-directing layer may be a self-assembled monolayer of a molecule. The layer may be a Langmuir-Blodgett film. Many types of Langmuir-Blodgett films, as well as methods of producing them, are known in the art. Typically, a Langmuir-Blodgett film is a monolayer of amphiphilic molecules adsorbed and assembled vertically on a substrate. The amphiphilic molecule of the Langmuir-Blodgett film may have a hydrophilic head and hydrophobic tail. The amphiphilic molecule may be a fatty acid, a protein, a protein fragment or a peptide.

Many biological materials or molecules have naturally occurring amines, such as proteins and various other biomolecules. Thus, the substrate may be a biological material, such as tissue or cells derived from an animal or plant source. The substrate may be bacteria or virus. The tissue or cells may be live or fixed or otherwise preserved. The substrate may comprise a biological molecule, e.g., a sugar, a fatty acid, a protein, a protein fragment or a peptide.

The deposition-directing layer onto which the gold coating is applied may comprise one or more molecules with an amine moiety (in other words, the charged moiety of the molecule or molecules incorporated into the deposition-directing layer may be an amino group). The amine may be a primary amine (—$NH_2$) that may be a protonated in an aqueous environment to form an amino group (—$NH_3^+$). Alternatively, the amine may be a secondary amine or a tertiary amine. The layer onto which the gold coating is applied may be an amine-functionalized layer on a surface the substrate. A wide range of amine-displaying substances and synthetic routes for amine functionalization of surfaces are known in the art, and may be used in the method of the present invention.

The amine-comprising molecule (i.e., the molecule with an amine moiety) may be a biological molecule, such as a sugar, fatty acid, protein, a protein fragment or a peptide. The protein, protein fragment or peptide may include at least one lysine residue. The peptide may be, for example, a proline-(lysine-phenylalanine)$_5$-lysine-proline peptide (alternatively referred to as a PKFKFKFKFKFKP peptide).

The amine-comprising molecule may be an aminosilane. An aminosilane may covalently bond with the substrate (silanization) and form a stable layer of amine moieties on the surface of the substrate. Examples of aminosilanes include, but are not limited to:

3-aminopropyl-triethoxysilane (APTES, alternatively APES);
3-aminopropyl-diethoxymethylsilane (APDEMS);
3-aminopropyl-dimethylethoxysilane (APDMES);
3-aminopropyl-trimethoxysilane (APTMS);
3-aminopropyl-methyldimethoxysilane;
bis[(3-triethoxysilyl)propyl]amine;
bis(3-trimethoxysilyl)prolyl]amine;
aminoethylaminopropyltrimethoxysilane;
aminoethylaminoprolyltriethoxysilane;
aminoethylaminopropylmethyldimethoxysilane;
aminoethylaminoprolylmethyldiethoxysilane;
aminoethylaminomethyltriethoxysilane;
aminoethylaminomethylmethyldiethoxysilane;
deithylenetriaminopropyltrimethoxysilane;
diethylenetriaminopropyltriethoxysilane;
diethylenetriaminopropylmethyldimethoxysilane;
diethylenetriaminopropylmethyldiethoxysilane;
diethylenetriaminomethylmethyldiethoxysinale;
diethylaminomethyltriethoxysilane;
diethylaminomethylmethyldiethoxysilane;
diethylaminomethyltrimethoxysilane;
diethylaminopropyltrimethoxysilane;
diethylaminopropylmethyldimethoxysilane;
diethylaminopropylmethyldiethoxysilane; and
N—(N-butyl)-3-aminoprolytrimethoxysilane.

In a preferred embodiment, the molecule incorporated into the layer provided on the surface sought to be gold-coated comprises at least one primary amine. In a further preferred embodiment, the deposition-directing layer comprises 3-aminopropyl-triethoxysilane.

In the silanization process, a hydroxyl group from the substrate attacks and displaces one or more of the alkoxy groups on the silane, thus forming a covalent bond (—X—O—Si—; the X being a metalloid atom from the substrate, or a carbon atom in case of a polymer, and the Si being the silicon atom of the silane). Thus, it will be understood that at least one of the alkoxy groups of every silane molecule covalently bound to the substrate is not present. Methods describing silanization procedures for modifying the surface of various substrates are well known, as set forth above.

The deposition-directing layer provided on the surface sought to be gold-coated can be patterned. The pattern may be created by, e.g. placing a mask on the substrate prior to forming the deposition-directing layer on the substrate. Alternatively, the pattern may be created through plasma etching.

The contacting of a solution of gold thiocyanate complex with the substrate sought to be coated may take place at a range of temperatures and durations. The temperature during said contacting may be, e.g., about 4° C., between 4° C. and room temperature, or room temperature. Room temperature may be about 25° C. The duration of the contacting may be as needed for the level of gold deposition desired. The duration of the contacting may be dependent of the temperature during the contacting. The duration of the contacting may be not less than 15 minutes, e.g., not less than 1 hour; for example an about 12 hours, about 24 hours, about 48 hours, about 60 hours, about 72 hours, between 24 and 48 hours, between 24 and 72 hours, or between 48 and 72 hours.

The binding of the gold thiocyanate complex to the deposition-directing layer may be driven by electrostatic attraction between the negatively charged complex and the positively charged moiety of the molecules incorporated in the deposition-directing layer. Without wishing to be bound by theory, it is believed that the gold deposition consists of two successive stages: (1) a spontaneous specific binding and crystallization of the gold complex on the deposition-directing layer, followed by (2) a spontaneous reduction of the $Au^{p+}$ in the bound metal providing complex into metallic form. Through the spontaneous reduction, the gold atom may be released from the gold complex.

Following the contacting of the gold thiocyanate complex aqueous solution with a deposition-directing layer of the substrate, the substrate may be rinsed to remove extraneous unbound complex, then dried. The drying may be done at room temperature (about 25° C.) or at other temperatures, including higher temperatures.

Further, the gold thin film deposition method of the present disclosure may be a one step process. That is, all that is needed for the gold to deposit on the deposition-directing layer and be reduced to metallic form is to contact the substrate with the gold thiocyanate complex solution. Additional steps, such as application of an electric field, preparing metal colloids or nanoparticles, pre-deposition of metallic structures designed to serve as nucleating/catalytic-reducing sites, or treatment with a reducing agent, are not needed.

Another aspect of the invention is gold thin film supported on a substrate. The gold thin film may be an aggregation of gold nanostructures, with the nanostructure having a ribbon-like shape (a "nano-ribbon"), that is, in the shape of a flattened strip. Alternatively or in combination, the gold nanostructure may have a nano-flake like shape, that is, a flattened irregular shape.

The metal thin film may be an aggregation of metal nanostructures that protrude from the substrate surface. The metal nanostructures may be interlaced or interconnected with other nearby nanostructures. Thus, the metal thin film may be a mesh of many nanostructures. The metal nanostructures may have a thickness of about 5 nanometers, about 10 nanometers, about 15 nanometers, about 20 nanometers, about 25 nanometers, about 30 nanometers, about 35 nanometers, about 40 nanometers, about 45 nanometers, about 50 nanometers, between 5 and 50 nanometers, between 10 and 40 nanometers, between 15 and 30 nanometers, between 20 and 30 nanometers or between 30 to 400 nm. The nanostructure may be a nano-ribbon or a nano-flake.

The thickness of the metal thin film may be about 50 nanometers, about 60 nanometers, about 70 nanometers, about 80 nanometers, about 90 nanometers, about 100 nanometers, about 125 nanometers, about 150 nanometers, about 175 nanometers, about 200 nanometers, about 250 nanometers, about 300 nanometers, between 50 and 300 nanometers, between 50 and 200 nanometers, between 100 and 200 nanometers, between 100 and 300 nanometers or between 30 and 400 nanometers.

The gold nanostructures which form the mesh are non-straight. The mesh may be compact, with little or no gaps between the metal nanostructures. Alternatively, the mesh may have gaps in the intervening space between nanostructures. As such, only a portion of the volume of the gold thin film may be taken up by the gold nanostructures, with the rest of volume being empty space. This nano-scale structure of the deposited gold provides high transparency combined with high electrical conductivity.

The conductivity of the gold films deposited by the second variant of the process of invention can be enhanced in several ways. For example, the substrate-supported gold film can be subjected to a reduction step, e.g., plasma reduction, to convert $Au^{1+}$ to $Au^0$. The number and size of the gaps existing between the gold nano-ribbons forming the film can be decreased, for example, via the application of one or more layers of a conductive polymer onto the gold film. For example, a mixture of poly(3,4-ethylenedioxythiophene):poly(styrenesulfonate) [PEDOT:PSS] is used to coat the film, by means of spin coating or other conventional techniques.

BRIEF DESCRIPTION OF THE DRAWINGS

FIGS. 3*a* and 3*b* are XRD obtained for the gold wires (deposited from a solution of gold thiocyanate complex in DMSO/water) before and after plasma reduction, respectively.

FIG. 4 is the transmittance spectrum of the gold wires (deposited from a solution of gold thiocyanate complex in DMSO/water) after plasma reduction.

FIG. 5 is a current/voltage curve recorded for a conductivity experiment for the gold nanowires (deposited from a solution of gold thiocyanate complex in DMSO/water).

FIGS. 6*a* and 6*b* are the XPS spectra depicting the relative abundance of Au species in the film (deposited from a solution of gold thiocyanate complex in DMSO/water) before and after plasma reduction, respectively ($Au^0$ is indicated by the darker line and the arrow).

FIG. 10A shows a template mask employed for creating an amine-functionalized surface upon a silicon-oxide substrate. FIGS. 10B-10C are scanning electron microscopy (SEM) images showing the selective growth of gold nanostructures on an amine functionalized substrate. FIG. 10D shows a height measurement trace based on atomic force microscopy (AFM) images along the edge of a region of deposited gold that was scratched off, exposing the amine-functionalized surface. FIG. 10E is an SEM image showing a cross-section of the gold deposit.

EXAMPLES

Methods

Figure 1:
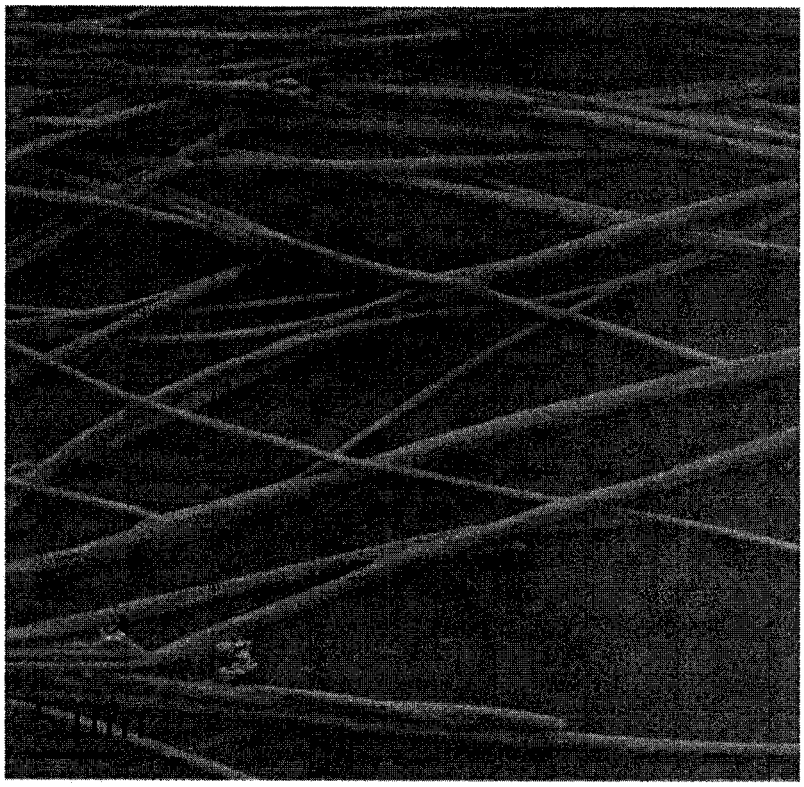
FIG. 1 is a SEM image showing the network arrangement of the individual gold wires deposited on a glass substrate, using a solution of gold thiocyanate complex in DMSO/water as the electroless deposition solution.

Scanning Electron Microscopy (SEM):

(i) For SEM images, gold nano-ribbons were grown on silicon, with thermal oxide layer of 100 nm, the wafer being modified with a 3-aminopropyltriethoxy silane self-assembled monolayer. SEM images were recorded using JEOL JSM-7400F Scanning Electron Microscope (JEOL LTD, Tokyo, Japan). (ii) For SEM images, 20 μL of a 24 h incubated solution of $KAu(SCN)_4$ (24 mg $mL^{-1}$) was drop cast on a silicon piece (2.5*1.0 $cm^2$) and the solvent was left to evaporate at room temperature. SEM images were recorded on a JEOL JSM-7400F Scanning Electron Microscope (JEOL LTD, Tokyo, Japan) at an acceleration voltage of 3 kV.

High Resolution Transmission Electron Microscopy (HR-TEM):

samples were prepared as follows. Dodecylamine films, compressed to surface pressure of 25 mN/m, on a Langmuir trough at 20° C. were transferred horizontally onto 400 mesh copper formvar/carbon grids (Electron Microscope Sciences, Hatfield, Pa., USA). The grids were allowed to float on solution of $Au(SCN)_2^{1-}$ for 1 h after which the sample left to dry and were plasma cleaned prior to analysis. HRTEM images were recorded on a 200 kV JEOL JEM-2100F. SEM analysis of grid left for 24 hours in the same solution was done to confirm the formation of nanoribbons.

Powder X-Ray Diffraction (XRD):

XRD patterns were obtained using Panalytical Empyrean Powder Diffractometer equipped with a parabolic mirror on incident beam providing quasi-monochromatic Cu Kα radiation (λ=1.54059 Å) and X'Celerator linear detector. Data were collected in the grazing geometry with constant incident beam angle equal to 1° in a 2θ range of 10-80° with a step equal to 0.05°.

X-Ray Photoelectron Spectroscopy (XPS):

XPS analysis was carried out using Thermo Fisher ESCALAB 250 instrument with a basic pressure of $2\cdot10^{-9}$ mbar. The samples were irradiated in 2 different areas using monochromatic Al Kα, 1486.6 eV X-rays, using a beam size of 500 μm. The high energy resolution measurements were performed with pass energy of 20 eV. The core level binding energies of the Au4f peaks were normalized by setting the binding energy for the C1s at 284.8 eV.

Infrared Measurements:

IR measurements were done in the following way: a solution of $Au(SCN)_4^{1-}$ was placed to incubate in 25° C. for 72 h to get oxidation of thiocyanate. After 72 h the solution was separated from the precipitation (solid gold) by filtration and solid $Ba(NO_3)_2$ was added in excess to the solution for the formation of $BaSO_4$. The solution was centrifuge and the precipitation was placed on a silicon wafer and left to dry in room temperature prior to analysis. Control samples were prepared by adding $Ba(NO_3)_2$ to 2 M $H_2SO_4$ solution and 2 M KSCN solution. The solution with KSCN shows no precipitation. The $H_2SO_4$ with add $Ba(NO_3)_2$ was centrifuge and the precipitation was placed on a silicon wafer and left to dry prior to analysis. The data was recorded by FTIR microscopy, Nicolet iN10.

Atomic Force Microscopy (AFM):

AFM measurements were performed at ambient conditions using a Digital Instrument Dimension3100 mounted on an active anti-vibration table. A scratch on the deposited gold was made and the height difference on the edge of the scratch was measured. A second scratch perpendicular to the first was done in order to check that the scratch removed only the gold thin film and did not harm the surface of the substrate.

UV-vis spectra (i.e. Plasmon transmittance) were recorded using a JASCO V-550 UV-vis spectrophotometer.

Conductivity measurements were conducted as follows: a 10 nm layer of chromium follow by a 90 nm of gold was deposited on glass surface with gold thin film, using thermal evaporation, in order to create electrodes. The evaporation was done selectively using a mask with desirable gaps (100 μm). Room temperature electrical measurements were carried out in a two-probe configuration using a probe-station equipped with a Keithley 4200SCS semiconductor parameter analyzer.

Example 1

Preparation and Characterization of Gold Nanowires 1 mL of $HAuCl_4.3H_2O$ dissolved in water (24 mg $mL^{-1}$) was added to mL aqueous solution of KSCN (60 mg $mL^{-1}$). The precipitate formed was separated by centrifugation at 4000 g for 10 min in order to separate the complex from the solution which contains KCl and excess of KSCN. The precipitate was dried and dissolved in 2 mL mixture of DMSO and water (4:1 v:v). The solution was left to incubate for 24 h after which 100 μL, of solution was drop cast on a 1.0 cm*2.5 cm, ozone exposed glass slide, and left to evaporate at room temperature.

The glass was inserted to a plasma cleaner, PDC-32G, Harrick Plasma, and the vacuum pump was turned on and work for 90 s. After 90 s the sample was exposed to plasma, at high RF (18 W), for 3 min, effectively reducing $Au^{3+}$ to $Au^0$.

Figure 2A:
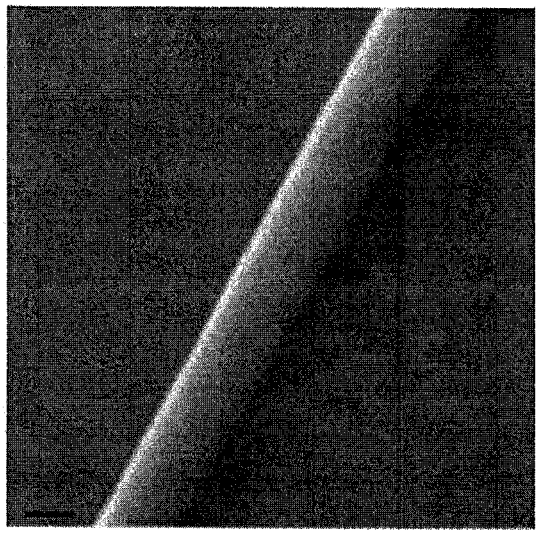
FIGS. 2*a* and 2*b* are SEM images illustrating the morphology of the gold wire (deposited from a solution of gold thiocyanate complex in DMSO/water) before and after plasma reduction, respectively.
Figure 2B:
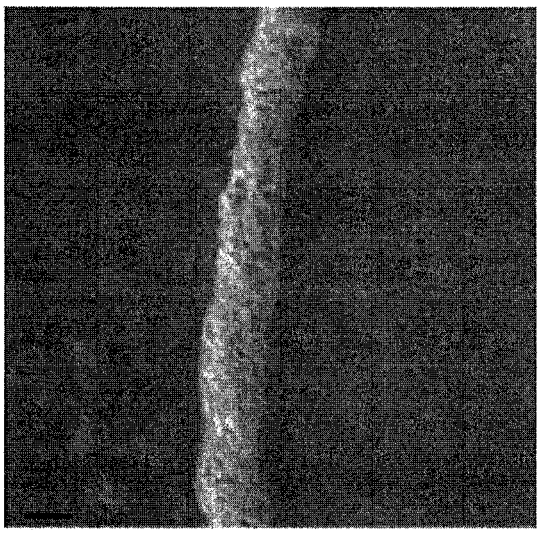

SEM image shown in FIG. 1 demonstrates a network structure consisting of individual long wires. FIG. 2*a* is the SEM image of a single wire (before plasma treatment), showing that the wire's surface is highly smooth. FIG. 2*b* is the SEM image of a single wire following plasma reduction, showing that the surface of the wire becomes coarse.

The X-ray powder diffraction patterns of the wires, before and after the reduction step, are presented in FIGS. 3*a* and 3*b*, respectively. The as-prepared wires exhibit X-ray powder diffraction pattern having peaks at 2θ positions corresponding to d-spacings of 8.34 Å, 6.11 Å and 2.90 Å, assigned to $KAu(SCN)_4$, and minor peaks at 2θ positions of 38 & 44 assigned to $Au^0$. A comparison with FIG. 3*b* illustrates the efficacy of the plasma reduction: the diffraction peaks assigned to the $KAu(SCN)_4$ crystalline species are significantly diminished in intensity following, plasma reduction, with the XRD peaks assigned to crystalline $Au^0$ becoming the prominent peaks. The ratio $Au/Au^{3+}$ is quantifiable through XPS and was found to be 77:23. FIGS. 6*a* and 6*b* are the XPS spectra depicting the relative abundance of Au species in the film before and after plasma reduction, respectively ($Au^0$ is indicated by the darker line to which the arrow points).

The essentially metallic, glass-supported film consisting of gold nanowires was also tested to determine its optical and electrical properties.

Optical transmittance: UV-Vis transmittance measurements in the range of 300-900 nm were conducted on a Carla 5000, Varian Analytical Instruments, Melbourne. FIG. 4 shows the transmittance spectrum, indicating that approximately 80% of the incident light was retained after passing through the nanowire film, demonstrating its excellent transparency.

Electrical conductivity: Cr and Au electrodes were thermally evaporated on glass substrate onto which the Au film was deposited. Each electrode consisted of 10 nm thick Cr layer, and on top of it 90 nm thick Au layer. The length and width of each Cr/Au electrode were 100 μm×100 μm. In one experiment, the electrodes were spaced 100 μm apart and in another experiment, the electrodes were spaced 1 mm apart, with the gold film being deposited in the spacing between the electrodes. Room temperature conductivity measurements were carried out in a two-probe configuration using a probe-station equipped with a Keithley 2400 SMU, and the current passing through the wires across the electrodes was measured. Data is presented in the form of current/voltage curves shown in FIG. 5, indicating that the network of gold nanowires exhibits good electrical conductivity.

Example 2

Figure 7:
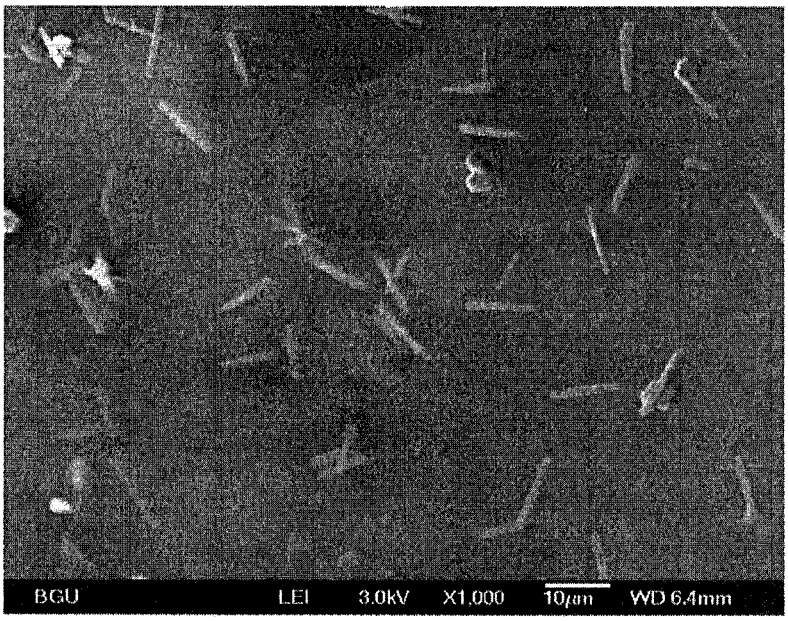
FIG. 7 is a SEM image showing individual gold wires deposited on a glass substrate, using a solution of gold thiocyanate complex in DMF/water as the electroless deposition solution.

Preparation of Gold Nanowires 14 mg $KAu(SCN)_4$ was dissolved in 2 mL of DMF and water (4:1 v:v). The solution was left to incubate for 24 h after which 20 μL of solution was drop cast on a 1.0 cm*2.5 cm, ozone exposed glass slide, and left to evaporate at room temperature. SEM images were recorded on a JEOL JSM-7400F Scanning Electron Microscope (JEOL LTD, Tokyo, Japan) at an acceleration voltage of 3 kV. The SEM image shown in FIG. 7 illustrates the formation of gold nanowires.

Example 3

Figure 8:
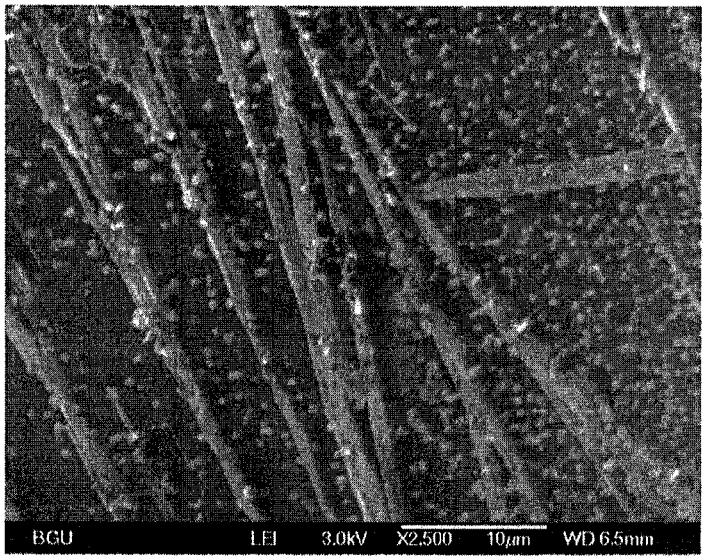
FIG. 8 is a SEM image showing individual gold wires deposited on a glass substrate, using a solution of gold thiocyanate complex in THF/water as the electroless deposition solution.

Self-Assembly of Gold Nanowires 14 mg KAu(SCN)4 was dissolved in 2 mL of THF and water (4:1 v:v). The solution was left to incubate for 24 h after which 20 μL of solution was drop cast on a 1.0 cm*2.5 cm, ozone exposed glass slide, and left to evaporate at room temperature. SEM images were recorded on a JEOL JSM-7400F Scanning Electron Microscope (JEOL LTD, Tokyo, Japan) at an acceleration voltage of 3 kV. The SEM image shown in FIG. 8 illustrates the formation of gold nanowires.

Example 4

Figure 9:
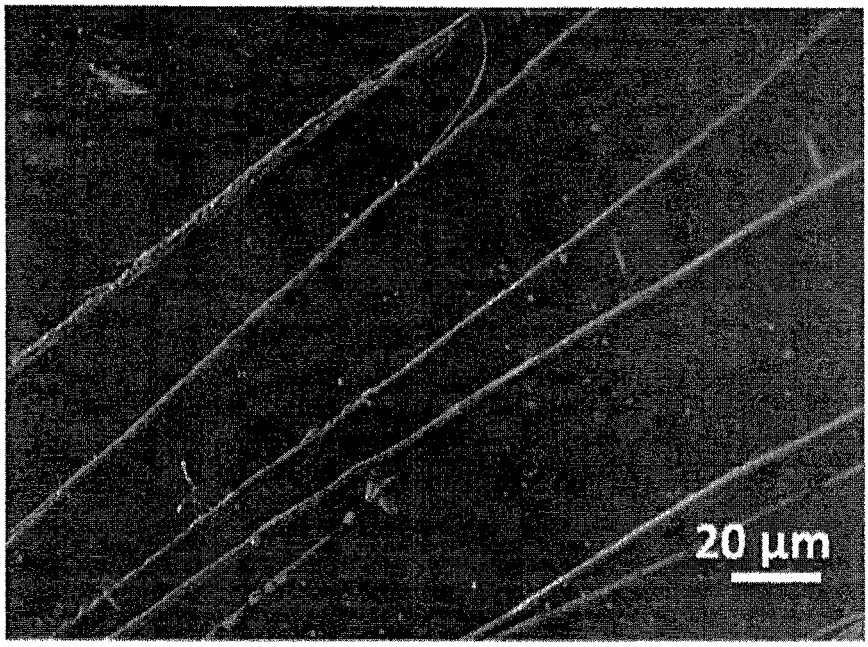
FIG. 9 is a SEM image showing individual gold wires deposited on a glass substrate, using a solution of gold thiocyanate complex in ethylene glycol/water as the electroless deposition solution.

Self-Assembly of Gold Nano-Wires 14 mg KAu(SCN)4 was dissolved in 2 mL of ethylene glycol and water (4:1 v:v). The solution was left to incubate for 24 h after which 20 μL of solution was drop cast on a 1.0 cm*2.5 cm, ozone exposed glass slide, and left to evaporate at room temperature. SEM images were recorded on a JEOL JSM-7400F Scanning Electron Microscope (JEOL LTD, Tokyo, Japan) at an acceleration voltage of 3 kV. The SEM image shown in FIG. 9 illustrates the formation of gold nanowires.

Example 5

Deposition of a Gold Film on Amino-Functionalized Substrate and Characterization of the Film Glass or silicon wafers with an amine terminal group deposition-directing layer were prepared as follows: The substrates were in a 70° C. piranha solution, 70% concentrated sulfuric acid and 30% hydrogen peroxide, for 30 min and another 30 min under sonication. The substrates were then rinsed with double distilled water and dried with compressed air stream. The dried substrates were immersed in a 1% (volume) of 3-aminopropyltriethoxy silane in heptane solution for 1 h which after the substrates were rinsed in cyclohexane and were left to dry prior to use. Silicon substrates were put in ozone oven for 30 min prior to the immersion in the amino silane solution. Patterned substrates were prepared by placing a mask on the substrate and exposing it to plasma for 1 min.

$Au(SCN)_4^{1-}$ complex was prepared as follows: 1 mL of $HAuCl_4.3H_2O$ in water (24 mg/mL) was added to a 1 mL solution of KSCN in water (60 mg/mL). The precipitation formed was separated by centrifuge (4000 g) for 10 min. X-ray photoelectron spectroscopy (XPS) analysis was done to confirm the existence of the complex.

Thin gold films were prepared as follows: The $Au(SCN)_4^{1-}$ (gold complex was transferred to 40 mL of water and sonicated in a sonication bath for 30 minutes. At this stage, the $Au(SCN)_2^{1-}$ complex is spontaneously formed. The concentration of the $Au(SCN)_2^{1-}$ complex was 1.5 mM. The substrate was inserted to the solution for 60 hours at 4° C. The substrate was oriented perpendicular to the ground, in order to prevent the fall of pre-formed aggregates on the substrate surface due to gravity. After 60 hours, the samples were rinsed with water and left to dry at room temperature.

The so formed gold film deposited on the amino-functionalized substrate was investigated and characterized as follows.

Figure 10A:
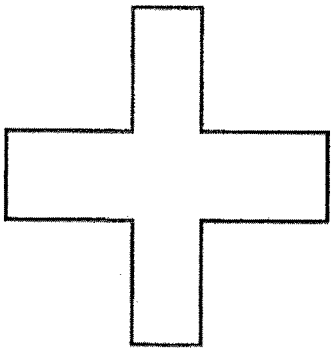
FIGS. 10A-10E demonstrates the morphology and dimensional characteristics of a gold film deposited on amino-functionalized substrate.

The morphology of the surface-deposited pattern was examined by scanning electron microscopy (SEM). FIG. 10A depicts an example of a template mask employed for creating an amine-functionalized surface upon a clean silicon-oxide substrate.

Figure 10B:
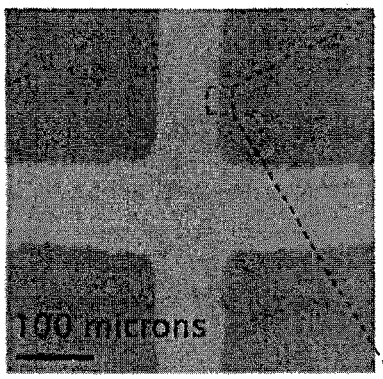
Figure 10C:
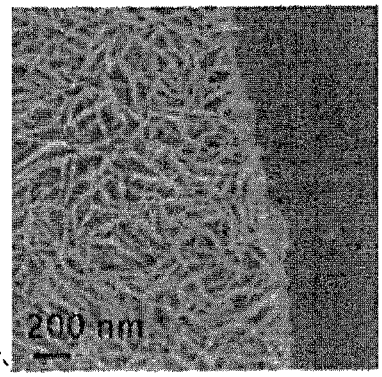

The SEM image of the resultant gold thin film in FIG. 10B (scale bar=100 microns) demonstrates that gold deposition (light) occurred exclusively within the surface areas in which $NH_2$ was displayed, and the surfaces not displaying $NH_2$ was essentially free of gold deposition (dark). Closer examination of the surface, as shown in FIG. 10C (scale bar=200 nanometers), reveals that the gold deposit has a complex structure. The gold is assembled into an aggregation of nano-ribbons that protrude from the substrate surface and interlace with other nearby nano-ribbons, creating a layer of gold nano-ribbon mesh. The nano-ribbons appear to be approximately 25 nm thick. The mesh is dense, such that the length of individual nano-ribbons cannot be determined. However, the mesh is loose enough such that small gaps are present in the mesh. Further, the presence of the deposited gold was specific to the amine-functionalized portion of the silicon-oxide surface, leaving a clear demarcation, even at the nanometer scale, between the portion of the surface with deposited gold and the portion without. The gold nano-ribbon assembly was not removed through prolonged washing and sonication, attesting to high stability and strong attachment to the surface.

Figure 10D:
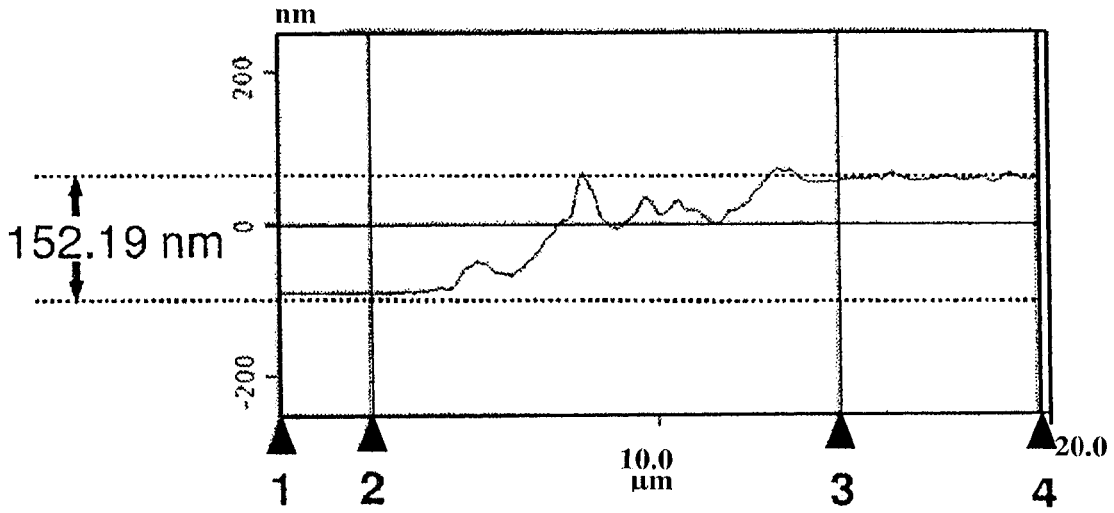
Figure 10E:
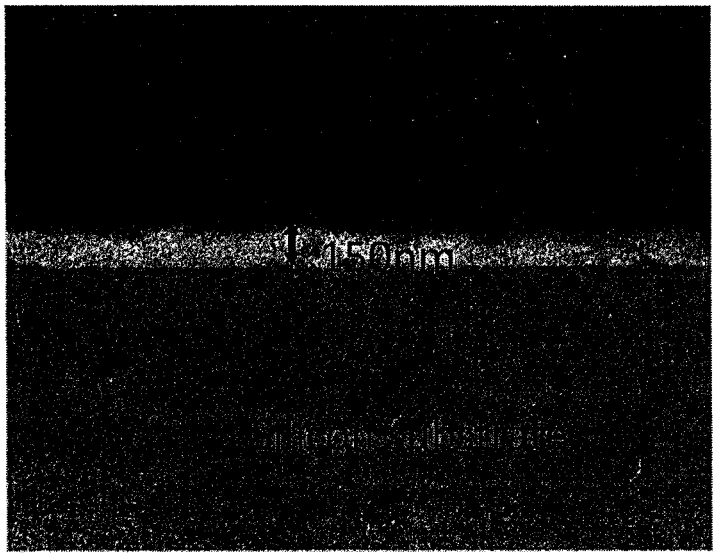

The thickness of the deposited gold was determined by AFM (FIG. 10D) and SEM (FIG. 10E). As shown in FIG. 10D, AFM height measurements were made near a scratch made on gold deposited on amine-functionalized glass. The distance between the glass substrate surface (measured at points 1 and 2) and the top of the gold deposit (measured at points 3 and 4), i.e., the thickness of the gold deposit, was determined to be 152.19 nm. A second scratch perpendicular to the first was done in order to check that the scratch removed only the gold structure. Separately, as shown in FIG. 10E, an SEM cross section image of a gold thin film created on amine-functionalized silicon similarly showed that the thickness of the gold deposit was uniform and approximately 150 nm.

Figure 11:
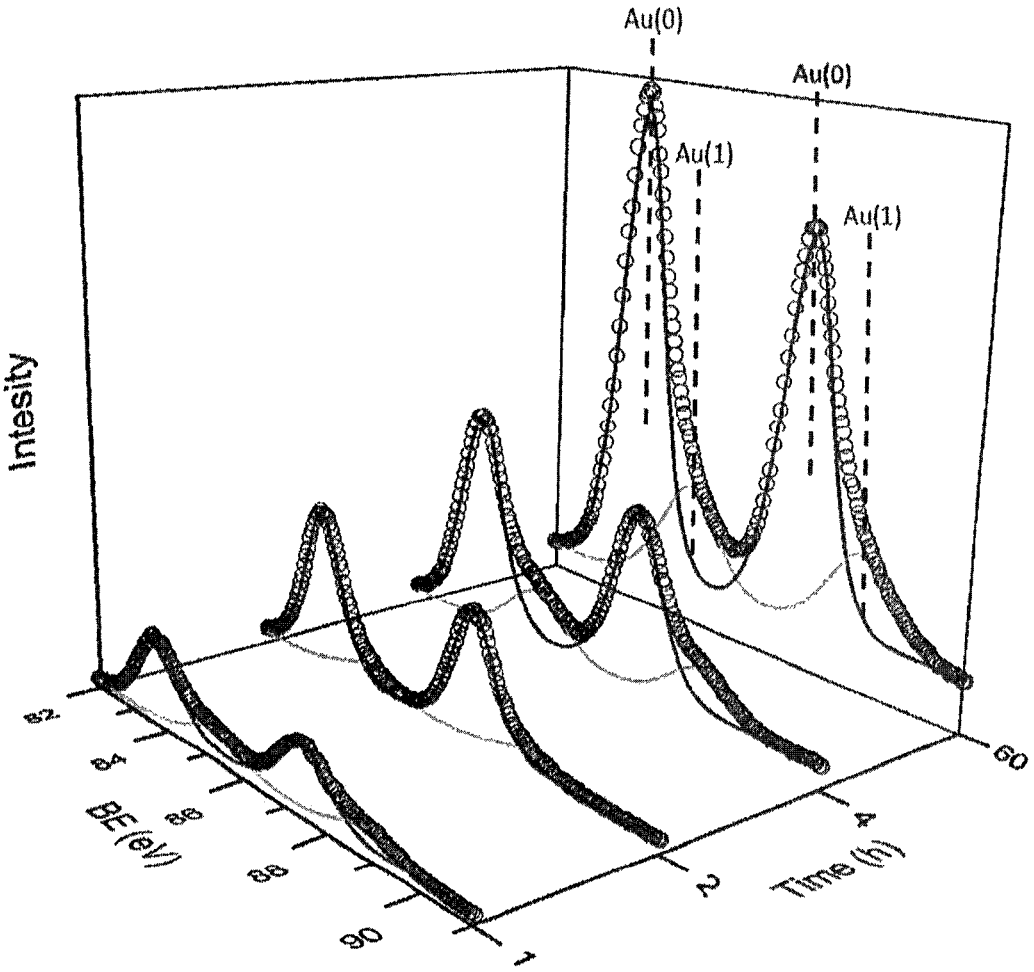
FIG. 11 is a graph showing the ratio of Au(I) to Au(0) on the deposited gold based XPS analysis.

To evaluate the gold species deposited upon the amine-displaying surface, we carried out x-ray photoelectron spectroscopy (XPS) experiments at different incubation times (FIG. 11). FIG. 11 shows that the XPS spectra in all time-points comprise superimposed peaks from Au(0) and Au(I). The XPS analysis demonstrates that most of the gold within the deposited nano-ribbon film is metallic, and the ratio between Au(0) and Au(I) remains almost constant, at 3:1, respectively, throughout the entire deposition process, as shown by the results set out in Table 1.

TABLE 1

Au species over time (based on data of FIG. 11)

| Time (h) | Au(I) | Au(0) |
|---|---|---|
| 1 | 0.27 | 0.73 |
| 2 | 0.19 | 0.81 |
| 4 | 0.24 | 0.76 |
| 60 | 0.24 | 0.76 |

This result indicates that spontaneous reduction of the gold thiocyanate complex occurs rapidly following binding and crystallization at the amine-functionalized surface. In order to further confirm that a reduction/oxidation reaction had taken place during incubation, we analyzed the used gold thiocyanate solution following incubation for oxidation residue by treating the used solution with $Ba(NO_3)_2$ and assaying for the formation of $BaSO_4$. We found that the used gold thiocyanate solution had significantly higher levels of oxidation residue compared to controls, which, as expected, contained no oxidation residues (data not shown).

As the XPS data point to rapid reduction of Au(I) to Au(0), one needs to determine whether the nano-ribbon gold structures (visualized in FIG. 10) and rapid reduction indeed occurred after adsorption of the gold complex to the surface. Several lines of evidence attest to this scenario. First, while some Au(0) colloids do form spontaneously in aqueous solution during the initial preparation of the $Au(SCN)_4^{1-}$ complex, such aggregates are generally structurally amorphous and lack the nano-ribbon structures (data not shown). Furthermore, while few Au(0) aggregates (pre-formed through spontaneous reduction pathways in the buffer solution) did bind to immersed surfaces, they were easily removed upon rinsing, in contradistinction to the gold nano-ribbons that were strongly bound to the substrate.

Figure 12A:
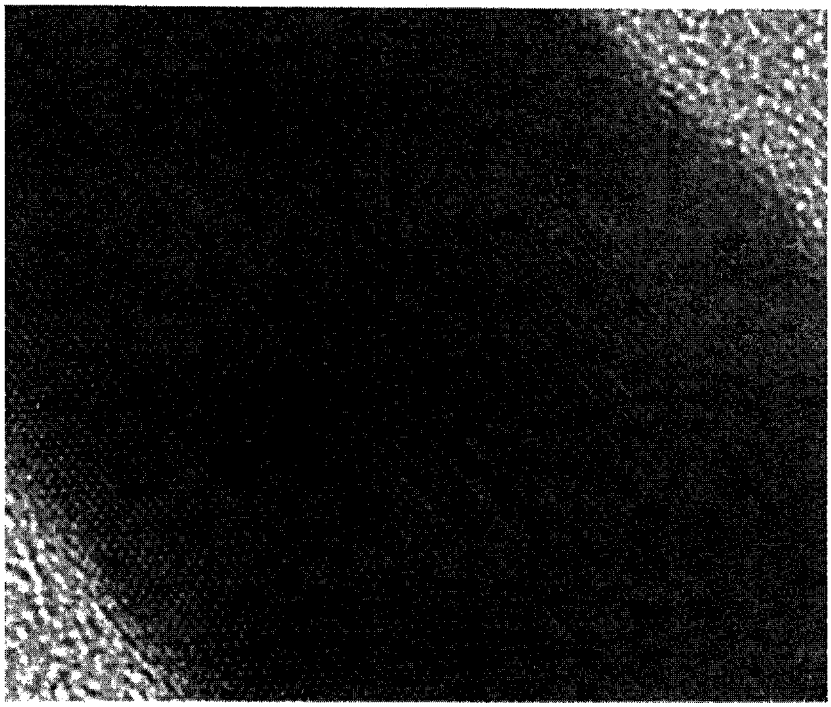
FIG. 12A is a high resolution transmission electron microscopy (HRTEM) image of a gold nano-ribbon (black).
Figure 12B:
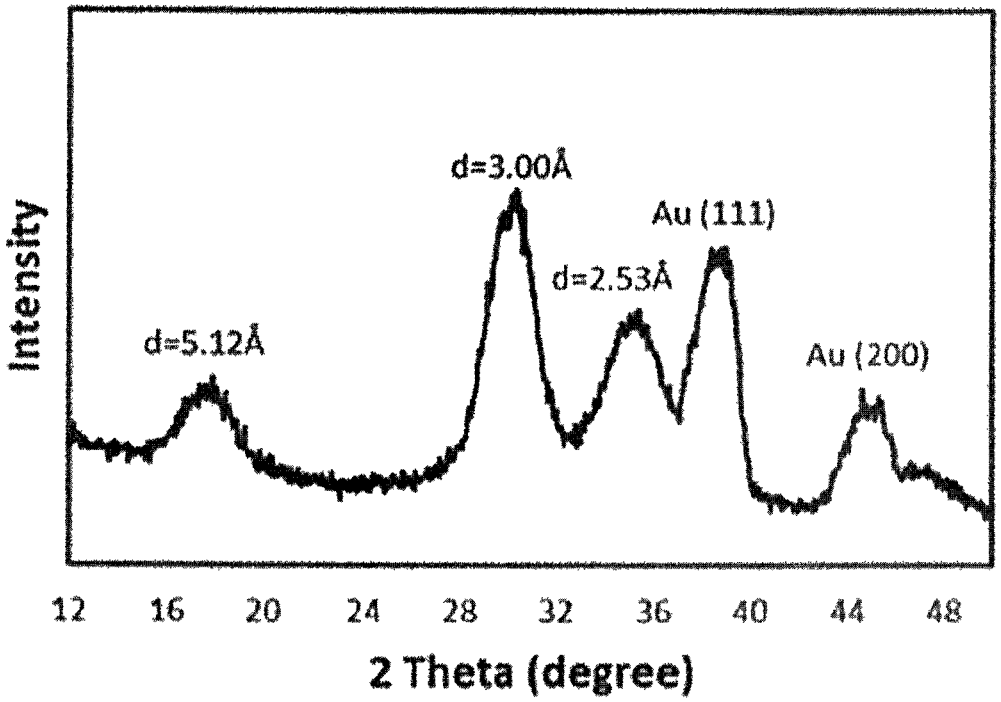
FIG. 12B is the x-ray diffraction (XRD) spectrum of the gold nano-ribbons grown on silicon oxide for 60 hours.

To analyze the molecular structures and crystallinity of the gold nanostructures we applied high resolution transmission electron microscopy (HRTEM, FIG. 12A), and X-ray diffraction (XRD, FIG. 12B). The HRTEM image of FIG. 12A (scale bar=10 nanometers) depicts the growth of a single gold nano-ribbon. Plasma cleaning was used prior to analysis. Crystal organization of both metallic gold and the $Au(SCN)_2^-$ complex are clearly apparent in the XRD pattern (FIG. 12B). The existence of both metallic gold, e.g., at (111) and (200), and gold organic hybrid structure, e.g., at d=2.53, 3.00 and 5.12 Å, are shown. The distances recorded in the XRD spectrum indicate that aurophilic interactions are pre-dominant in promoting gold crystallization upon the $NH_2$-functionalized surface.

Figure 13A:
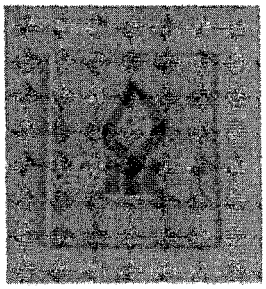
FIG. 13A is a photograph showing an image on a piece of paper seen through a piece of gold-deposited glass.
Figure 13B:
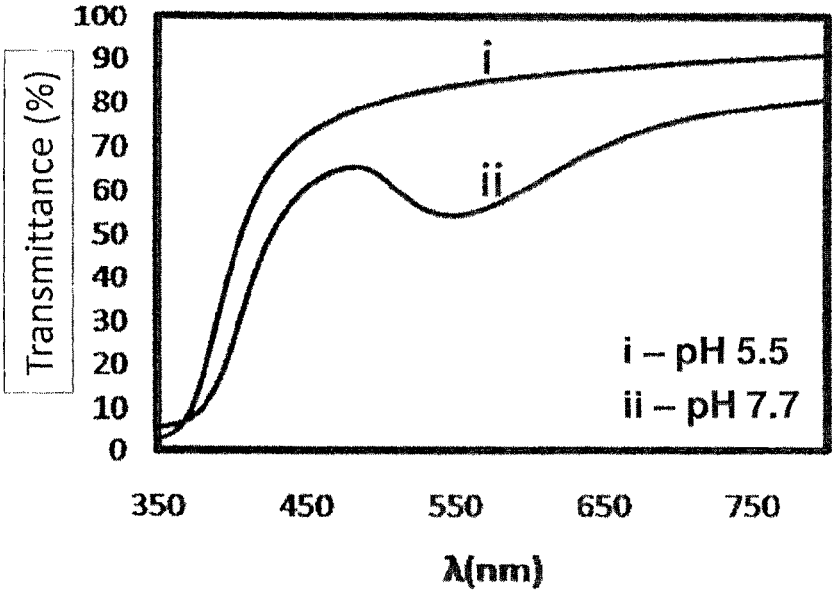
FIG. 13B is a trace showing the transmittance of light at or near the visible spectrum through gold-deposited glass at a range of wavelengths between 350 nm and BOO nm wavelength.

FIG. 13A shows the optical transparency of the gold thin film that is prepared according to the above methods. Gold thin film was deposited upon the entire surface of an amine-functionalized glass panel of approximately 1 cm in width, according to the methods described above. The glass panel was placed on a piece of paper having an image of a university logo printed on it. Even with the gold deposited upon it, the glass panel is highly transparent, such that the logo is clearly visible. FIG. 13B is a graph showing the relationship between the level of light transmittance through the deposited gold and the wavelength of the light. Except for the sharp dip in transmittance for short wavelength like (less than approximately 450 nm), transmittance of light in the visible spectrum ranged from about 55% to about 80% at pH 7.7 (in 10 mM phosphate buffer). Transmittance of light was even better at 5.5 pH, ranging from about 80% to about 90%. At pH 7.7, as at pH 5.5, there was an overall trend of transmittance being worse for lower wavelength light, and transmittance sharply fell for light of wavelengths less than approximately 450 nm.

Figure 13C:
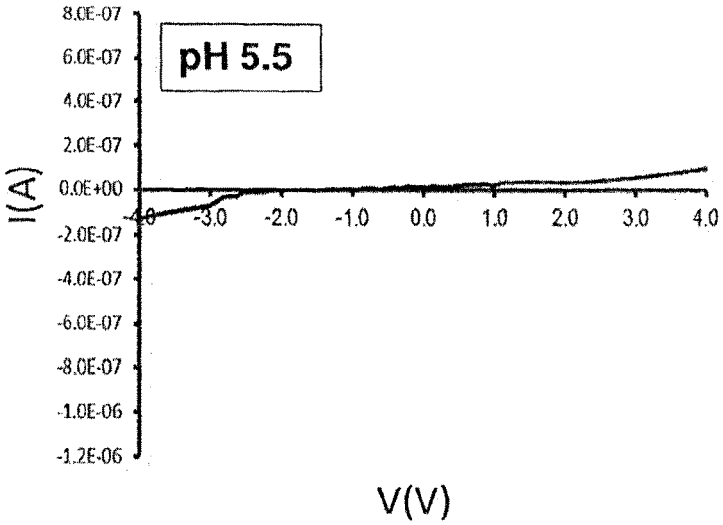
FIG. 13C is an I-V trace showing the current passed through the gold deposit at a range of voltages, between −4V and 4V, in a pH 5.5 environment.
Figure 13D:
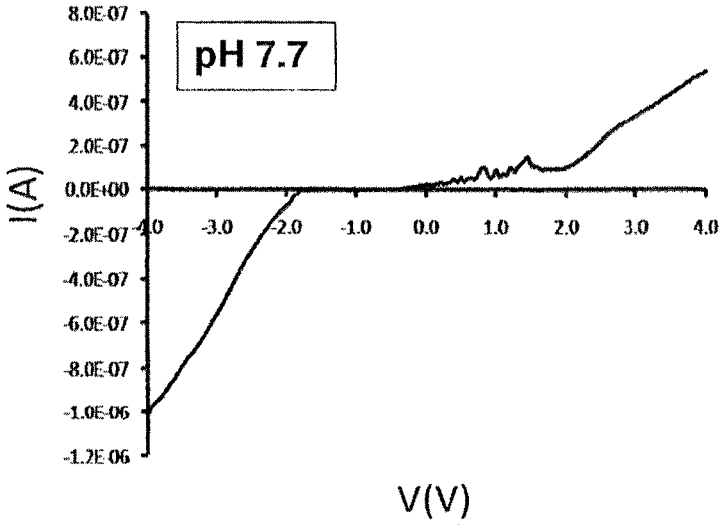
FIG. 13D is an I-V trace showing the current passed through the gold deposit at a range of voltages, between −4V and 4V, in a pH 7.7 environment.

FIGS. 13C-D shows the current-voltage relationship of a current being passed across the deposited gold film, showing that the gold is conductive. The higher conductivity at pH 7.7 compared to pH 5.5 is due to the release of H+ ion in the gold reduction reaction induced by the application of current. For example, at pH5.5, the application of a 4 V electrical potential resulted in a current of +1.009891E-7 A. At pH 7.7, an application of a 4 V potential resulted in a current of 5.367393E-7 A Both physical properties are related to the configuration of the gold structures. Specifically, the protruding orientation of the nano-ribbons and resultant large "empty" surface areas enables optical transparency. Similarly, conductivity depends upon the interface/contact between the individual gold nanostructures.

Example 6

Deposition of a Gold Film on Amino-Functionalized Substrate

Transmission electron microscopy (TEM) grids (400 mesh copper formvar/carbon grids; Electron Microscope Sciences™, Hatfield, Pa., USA) with amine-rich peptide deposition-directing layer were prepared as follows: A solution of proline-(lysine-phenylalanine)$_5$-lysine-proline (PKFKFKFKFKFKP) peptide in methanol/chloroform (1:9 v/v) was prepared at a concentration of approximately 0.1 mg/mL. An appropriate amount of the peptide solution was spread over a KCl (1 M) subphase in a Langmuir trough (KSV™ minitrough). Following evaporation of the methanol/chloroform solvent, the barriers of the trough were compressed at a rate of 4 mm/min. The surface pressure-area isotherm was recorded and was stopped at the required surface pressure. A monolayer of the peptides was transferred to the TEM grids at the desired surface pressure using the Langmuir-Schaefer method.

Gold growth over the peptide-treated TEM grids: For gold crystallization over the peptides, the TEM grids were kept floating over an aqueous solution of $K[Au(SCN)_2]$ (pH~5.5). After the desired duration of incubation in the gold complex solution, the grids were taken out and floated over deionized water to remove the unbound moieties and unreacted reagents. Samples were analyzed after drying.

Figure 14A:
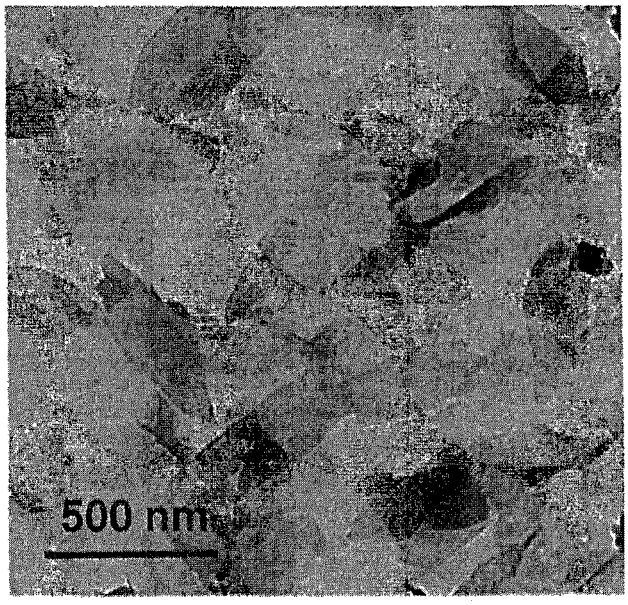
FIG. 14A is HRTEM image showing the peptides sheets bound (darker regions) to the substrate.
Figure 14B:
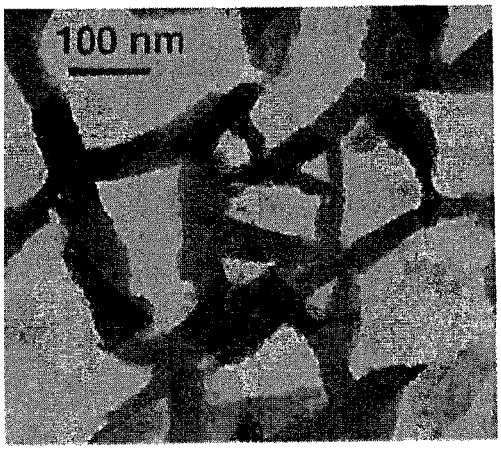
FIGS. 14B-C are HRTEM images showing the gold deposits (black strips) formed on the peptides sheets.
Figure 14C:
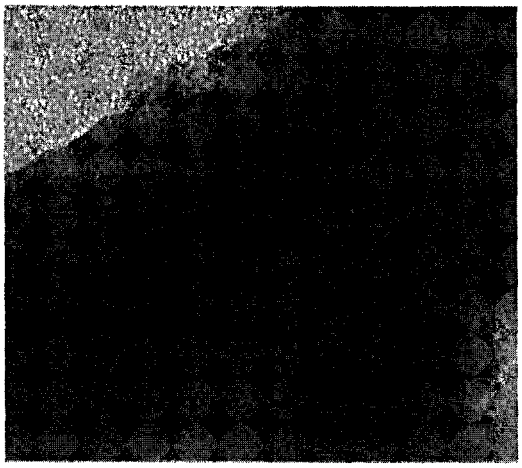
Figure 14D:
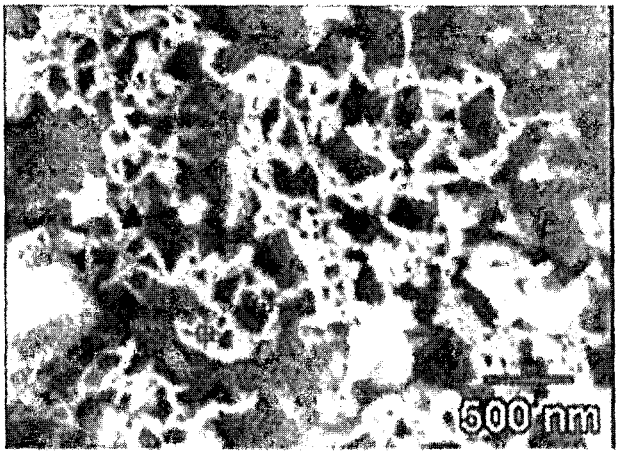
FIG. 14D is a SEM image showing the nano-ribbon structure of the deposited gold (white).

FIG. 14A (scale bar=500 nanometers) is a TEM image showing the peptides sheets bound (darker regions) to the substrate. FIG. 14B (scale bar=100 nanometers) shows a TEM image showing the gold deposits (black strips) formed on the peptides sheet after being incubated for 2 days with 1.5 mM $Au(SCN)_2^{1-}$ in aqueous solution. FIG. 14C (scale bar=10 nanometers) is a higher magnification TEM image showing a boundary between a section with gold deposition (black) and a section without gold deposition (white). FIG. 14D (scale bar=500 nanometers) is a SEM image showing the nano-ribbon structure of the deposited gold (white). Note that the deposited gold appears black in the TEM images (FIGS. 14B-C) and as white in the SEM images (FIG. 14D).

Example 7

Deposition of a Gold Film on Amino-Functionalized Substrate

Figure 15A:
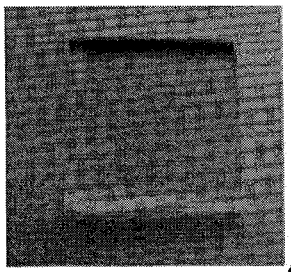
FIG. 15A is a photograph of a PDMS substrate without amine functionalization after incubation with $Au(SCN)_2^{1-}$.
Figure 15B:
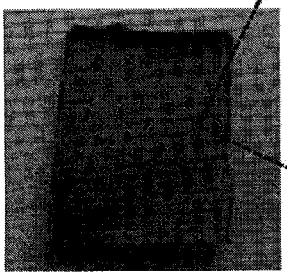
FIG. 15B, is a photograph of a PDMS substrate with amine functionalization after incubation with $Au(SCN)_2^{1-}$.
Figure 15C:
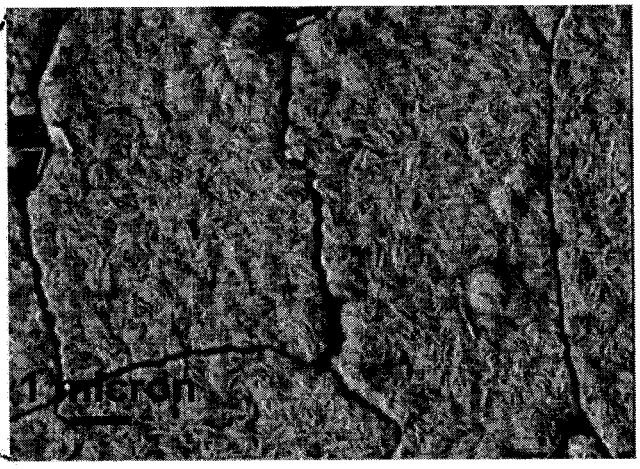
FIG. 15C is an SEM image showing the gold thin film nanostructure on the amine functionalized PDMS.

The above method of spontaneous gold thin film deposition may be conducted on a variety of substrates. FIG. 15A-C shows the successful deposition of gold thin film on amine functionalized polydimethylsiloxane (PDMS) using essentially the same methods. FIG. 15A is a photograph of a PDMS substrate (of about 1 cm in width) without amine functionalization after incubation with $Au(SCN)_2^{1-}$ in aqueous solution, showing that gold deposition did not take place. By contrast, as shown in FIG. 15B, incubating an amine (—$NH_2$) functionalized PDMS substrate (of about 1 cm in width) with $Au(SCN)_2^{1-}$ in aqueous solution resulted in gold deposition, as evidenced by the presence of a brownish red coating. FIG. 15C shows an SEM image of the gold nanostructure film on the amine functionalized PDMS.

Example 8

Deposition of Gold Films on Amino-Functionalized Planar and Non-Planar Substrates and Characterization of the Films Planar PDMS samples were prepared as per the instructions provided by the supplier (Sylgard 184 kit, including monomer and curing agent, was purchased from Dow Corning). The monomer and curing agent were mixed in a ratio 10:1 and cured at 70° C. for 2 hours on a hydrophobic surface. After curing, samples were peeled off from the supporting surface.

Wrinkled PDMS was made using a reported procedure [Lee et al., Adv. Mater 25, p. 2162 (2013)]. Briefly, PDMS films were initially prepared by mixing the elastomer and curing agent in a ratio of 20:1. These PDMS films were then mechanically pulled with uniaxial strain in a custom-made device and kept in an UVO oven for 40 minutes. Wrinkles were produced on the PDMS surface after releasing of the strain.

Amine modification of the PDMS surfaces was carried out as follows. The PDMS surfaces were first treated in plasma for 3 min and subsequently immersed in a solution containing ethanol, water and 3-aminopropyl triethoxy silane (APTES) in a ratio of 200:20:1 (v/v/v) for 2 hours. Following this treatment, the substrates were washed consecutively with ethanol and water and then dried in flow of compressed air.

$KAu(SCN)_4$ complex was prepared as described in the foregoing examples. 1 mL aqueous solution of $HAuCl_4.3H_2O$ (24 mg·mL$^{-1}$) was added to 1 mL solution of KSCN in water (60 mg·mL$^{-1}$). The precipitate formed was separated by centrifugation at 4000 g for 10 min. The supernatant was decanted and the residue was dried in room temperature.

Growth of Au films on PDMS substrates was accomplished as follows (the same procedure was used for gold film formation upon both the planar and wrinkled PDMS surfaces. Aqueous solutions of $Au(SCN)_4^{1-}$ (0.7 mg·mL$^{-1}$) was prepared in slightly acidic water (pH~5.5) and the amine-modified PDMS substrates were vertically immersed in the solution and kept at 4° C. for 3 days. After the gold growth was completed, the substrates were taken out of the growth solution and washed thoroughly with water for removing unreacted materials, and subsequently dried in room temperature.

Au/PDMS samples were treated in plasma for 40 to ensure complete reduction of the gold layer. 50 μL of a 1:2 v/v dispersion of poly(3,4-ethylenedioxythiophene):poly (styrenesulfonate) [PEDOT:PSS] in isopropanol was then dropped over the substrate and spin-coated for 1 minute at 1000 rpm.

The so formed gold films were investigated and characterized as follows.

Figure 16:
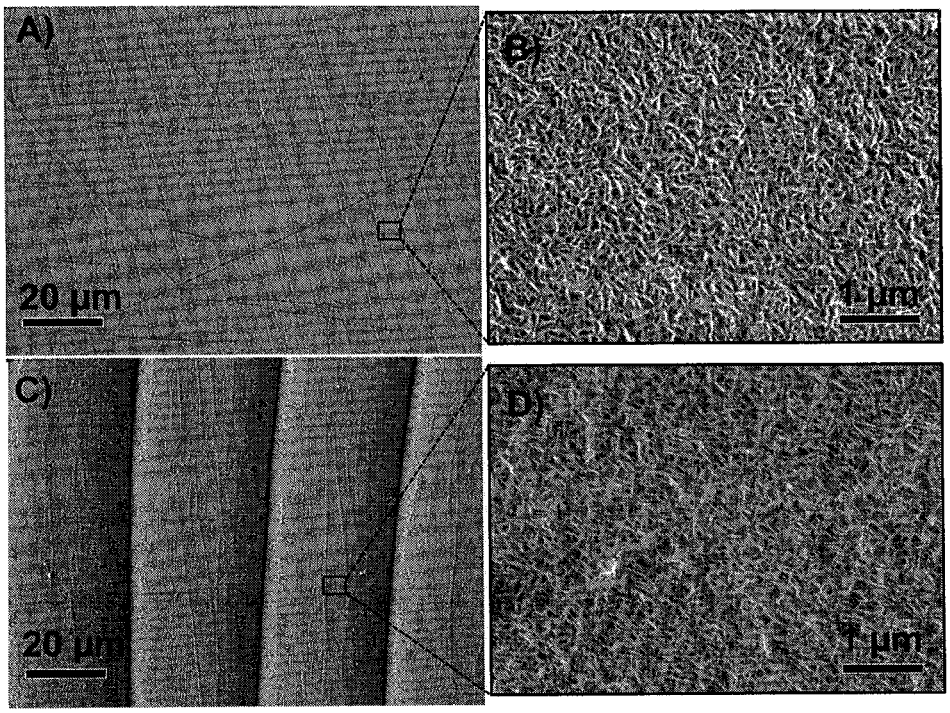
FIG. 16 shows Surface morphology of Au-coated PDMS. Scanning electron microscopy (SEM) images of Au-coated planar PDMS surface (A-B) and Au-coated wrinkled PDMS (C-D).

The morphology of the surface-deposited pattern was examined by scanning electron microscopy (SEM). The SEM images in FIGS. 16A and 16C underscore the uniform gold coverage of both the planar PDMS surface (FIG. 16A) or the wrinkled surface (FIG. 16C). Closer examination of the surface reveals a dense "nano-ribbon" morphology of the gold films (FIGS. 16B,16D), similar to films produced upon incubation of $Au(SCN)_4^{1-}$ with amine-modified glass surfaces. Atomic force microscopy (AFM) analysis implied a thickness of approximately 300 nm of the gold film deposited upon the PDMS.

Figure 17A:
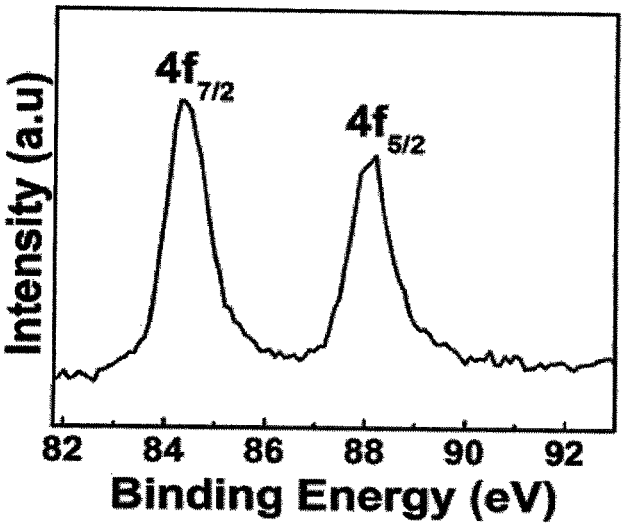
FIG. 17 provides the structural characterization of the Au films grown on PDMS: (A) XPS spectra in the Au(4f) region; (B) Powder XRD pattern.
Figure 17B:
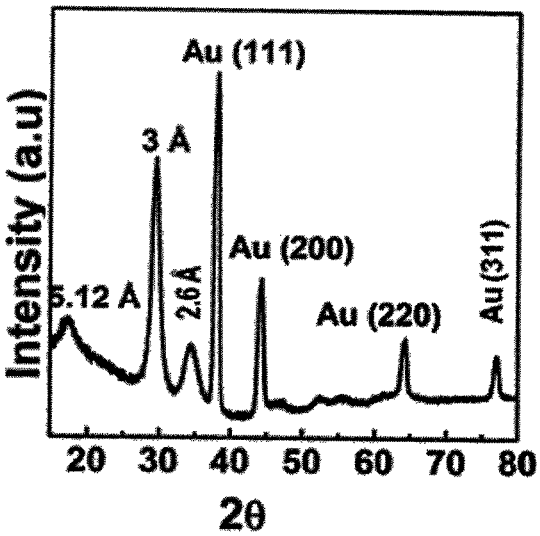

Chemical species and crystalline properties of the Au films grown at the PDMS surface was carried out through application of X-ray photoelectron spectroscopy (XPS) and powder x-ray diffraction (XRD) (FIG. 17A, 17B). The XPS spectrum in FIG. 17A shows two peaks corresponding to binding energies of 88.2 eV and 84.3 eV, respectively, ascribed to the $4f_{5/2}$ and $4f_{7/2}$ peaks of Au(0). This result confirms that the Au film predominantly comprises of Au(0). The XRD pattern in FIG. 17B highlights the crystallinity of the metallic Au(0) film, showing signals ascribed to Au (111), Au (200), Au (220) and Au (311) crystal planes, respectively. Additional peaks at 5.12 Å, 3 Å and 2.6 Å are assigned to $Au(SCN)_2^{1-}$ crystallites formed through aurophilic interactions. XPS and XRD analyses performed on Au films grown over the wrinkled PDMS surface gave similar results. Together, the XPS and XRD data in FIG. 17 demonstrate that the self-assembled films grown at the amine-derivatized PDMS surfaces mostly comprise of metallic, crystalline gold.

Figure 18A:
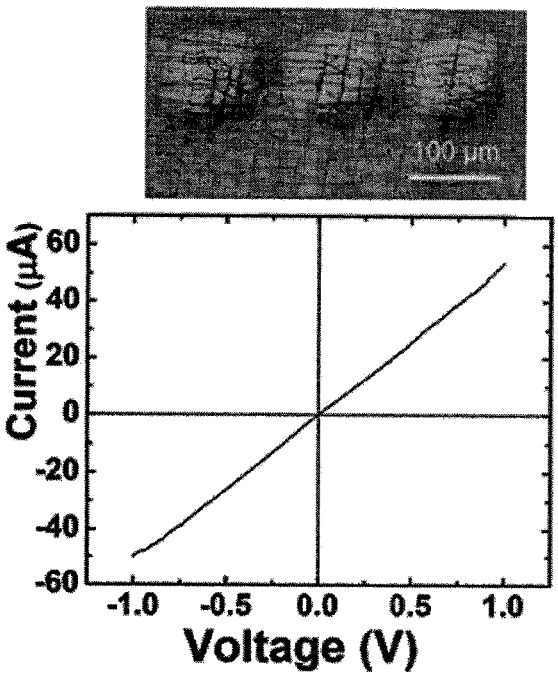
FIG. 18 presents the results of electrical conductivity in different PDMS surface morphologies. (A) Planar PDMS. Optical microscopy image of the electrode configuration (picture showing three bright square electrodes deposited on the surface) (top), and corresponding I-V curve (bottom); (B) Wrinkled PDMS. Optical microscopy image of the electrode configuration (picture showing three square electrodes) (top), and corresponding I-V curve (bottom); (C) Physical bending of coated PDMS. Picture of the experimental setup, showing the two electrodes in contact with the bent PDMS (the arrow points to the PDMS slab wrapped around a glass tube) (left); the corresponding I-V curve (right). The Ohmic (linear) behavior apparent in all I-V curves indicates electrical conductivity.
Figure 18B:
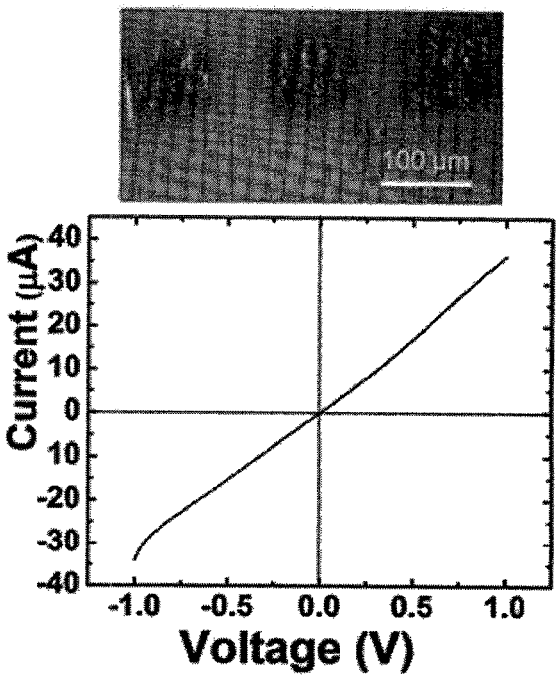

FIG. 18 presents the conductivity profiles of planar and non-planar PDMS surfaces. The linear current-voltage (I-V) curves recorded for the different surface morphologies in FIG. 18 underscore the significant electrical conductivity attained by the film fabrication according to the invention both for the planar and non-planar surfaces. It should be noted that PEDOT:PSS spin coating was carried out following gold deposition in order to enhance electron transport within the Au films. Addition of PEDOT:PSS gave rise to higher conductivity likely by filling the "grooves" on the Au/PDMS surface (which are apparent in the SEM images in FIG. 10C), as well as through "nano-soldering" of the interspersed Au nano-ribbons, overall eliminating possible gaps in electron transport. FIG. 18A (top) presents an optical microscopy image of the experimental setup for measuring conductivity in the planar Au/PEDOT:PSS/PDMS surface configuration, showing the square-shaped gold electrode pads deposited on the coated PDMS surface. The linear I-V curve recorded between adjacent electrodes corresponding to spacing of approximately 50 μm (FIG. 18A, bottom graph) indicates Ohmic behavior and reasonably good sheet resistance of $6\times10^3$ Ω·sq$^{-1}$. A remarkable conductivity profile was apparent for the wrinkled PDMS surface, FIG. 18B. The optical image in FIG. 18B, top, demonstrates that conductivity was measured over several "ridges" between adjacent electrode pads. Indeed, the I-V curve in FIG. 18B (bottom) demonstrates that electrical conductivity was retained even in this non-planar surface morphology. The wrinkled Au/PDMS sheet resistance of $14\times10^3$ Ω·sq$^{-1}$ is the same order of magnitude as the value obtained for the planar Au/PDMS surface (FIG. 18A), recorded in higher electrode spacings—underscoring the capability of the new approach to achieve effective coating of three-dimensional objects with a conductive layer. Notably, the planar PDMS sample was conductive up to 500 μm electrode spacings, while the wrinkled surfaces exhibited conductivity in up to 1 mm of electrode separation (not shown).

Figure 18C:
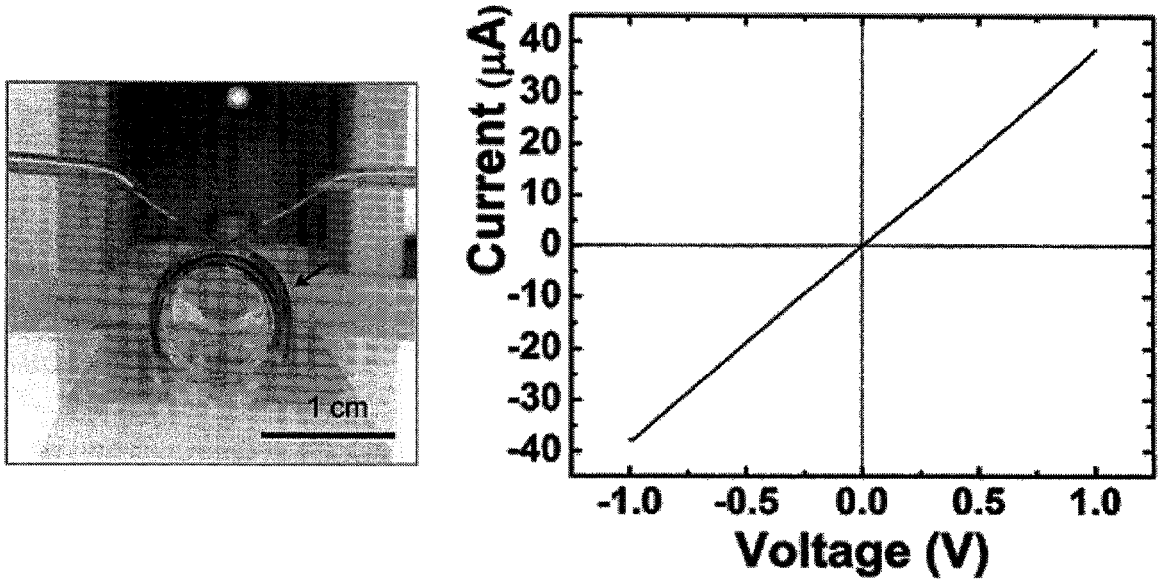

To further test the feasibility of the process of the invention for achieving conductivity in flexible, bent surface configurations, we examined the effect of mechanical modification of surface curvature (FIG. 18C). As shown in the photograph in FIG. 18C (left), the flat Au-coated PDMS slab (complemented with PEDOT:PSS surface treatment) was bent around a low-diameter glass tube and the conductivity was measured between two electrodes placed upon the bent PDMS surface. The I-V curve in FIG. 18C (right) clearly demonstrates that even in the bent configuration (around 2.2 cm$^{-1}$ curvature) the coated PDMS retained its conductivity. Indeed, the sheet resistance measured—$8\times10^3$ Ω·sq$^{-1}$—was comparable to the value recorded in the initial, planar configuration. It should be emphasized that conductivity in all cases was directly related to the deposition of the Au film upon the PDMS surface. Specifically, control experiments demonstrated that PDMS or amine-modified PDMS that were not incubated with the Au thiocyanate complex were not conductive even after treatment with PEDOT:PSS.

The invention claimed is:

1. An electroless process for depositing gold from a solution, comprising providing a solution of a source of of gold thiocyanate complex comprising $M^+[Au(SCN)_4]^{1-}$, or $M_+[Au(SCN)_2]^{1-}$, wherein M is a metal, and combinations thereof, and subjecting a substrate sought to be gold-plated to said solution to deposit $Au^0$ from said solution, wherein said deposition is a spontaneous reduction of gold of said complex by thiocyanate carried out in the absence of an auxiliary reducing agent, further wherein 1) said solution is said gold thiocyanate complex dissolved in a mixture of water-miscible organic solvent and water, and said spontaneous reduction occurring upon evaporation of said solution, or
2) at least a portion of said surface comprises a deposition-directing layer comprising positively charged non-metallic groups.

2. A process according to claim 1, wherein said gold thiocyanate complex dissolved in a said mixture of water-miscible organic solvent and water is $[Au(SCN)_4]^{1-}$, and wherein said process comprising crystallizing $Au^0$ wires from said solution.

3. A process according to claim 2, wherein the crystallization is induced by gradually removing the solvent mixture.

4. A process according to claim 3, wherein the gradual solvent removal is achieved by allowing the solvent mixture to evaporate slowly.

5. A process according to claim 2, wherein the $Au^0$ wires contain $Au^{3+}$ compound.

6. A process according to claim 5, further comprising the step of subjecting the wires to a reductive environment, increasing the content of Au0 in the wires.

7. A process of claim 2, wherein the water-miscible organic solvent is aprotic solvent.

8. A process according to claim 7, wherein the solvent is dimethyl sulfoxide.

9. A process according to claim 1, wherein said $Au^0$ deposition takes place onto said deposition-directing layer upon contacting said gold thiocyanate complex, with said deposition-directing layer.

10. A process according to claim 9, wherein the positively charged non-metallic groups are organic groups.

11. A process according to claim 10, wherein the positively charged organic groups include positively charged amine groups.

12. A process according to claim 9, wherein the substrate is either planar or curved, non-metallic substrate.

13. A process according to claim 9, further comprising a step of enhancing the electrical conductivity of the film.

14. A process according to claim 13, comprising one or more of the following steps:

(i) subjecting the film to a reductive environment, thereby increasing the content of $Au^0$ in the film;

(ii) treating the film with a conductive polymer.

15. An electroless process for depositing gold from a solution comprising providing a solution of a source of gold thiocyanate complex selected from the group consisting of $M^+[Au(SCN)_4]^{1-}$, $M^+[Au(SCN)_2]^{1-}$, wherein M is a metal, and combinations thereof, and and subjecting a substrate sought to be gold-plated to said solution to deposit Aufrom said solution, wherein said deposition is a spontaneous reduction of gold of said complex by thiocyanate carried out in the absence of an auxiliary reducing agent, and further wherein said solution is said gold thiocyanate complex dissolved in a mixture of water-miscible organic solvent and water, and said spontaneous reduction occurring upon evaporation of said solution.

16. An electroless process for depositing gold from a solution onto a substrate, comprising providing a solution of of a source of gold thiocyanate complex selected from the group consisting of $M^+[Au(SCN)_4]^{1-}$, $M^+[Au(SCN)_2]^{1-}$, wherein M is a metal, and combinations thereof, and subjecting a substrate sought to be gold-plated to said solution to deposit $Au^0$ from said solution, wherein said deposition is a spontaneous reduction of gold of said complex by thiocyanate carried out in the absence of an auxiliary reducing agent upon evaporation of said solution, and further wherein at least a portion of said surface comprises a deposition-directing layer comprising positively charged non-metallic groups upon evaporation of said solution.

* * * * *